US011626693B2

(12) United States Patent
Hu et al.

(10) Patent No.: US 11,626,693 B2
(45) Date of Patent: Apr. 11, 2023

(54) ELECTRICAL CONNECTOR AND CONNECTOR ASSEMBLY

(71) Applicant: LOTES CO., LTD, Keelung (TW)

(72) Inventors: Xin Hu, Keelung (TW); Yi Yu, Keelung (TW); Zhi Jie Li, Keelung (TW)

(73) Assignee: LOTES CO., LTD, Keelung (TW)

( * ) Notice: Subject to any disclaimer, the term of this patent is extended or adjusted under 35 U.S.C. 154(b) by 24 days.

(21) Appl. No.: 17/533,241

(22) Filed: Nov. 23, 2021

(65) Prior Publication Data

US 2022/0239041 A1 Jul. 28, 2022

(30) Foreign Application Priority Data

Jan. 25, 2021 (CN) ..... 202110099798.X
Mar. 22, 2021 (CN) ..... 202120582142.9

(51) Int. Cl.
*H01R 13/6471* (2011.01)
*H01R 12/73* (2011.01)

(52) U.S. Cl.
CPC ..... *H01R 13/6471* (2013.01); *H01R 12/737* (2013.01)

(58) Field of Classification Search
CPC ..... H01R 13/6471; H01R 12/737; H01R 12/712; H01R 12/721; H01R 12/73; H01R 12/735; H01R 24/60; H05K 1/0222; H05K 1/115
USPC ..... 439/660, 636, 62, 72, 637
See application file for complete search history.

(56) References Cited

U.S. PATENT DOCUMENTS 4,992,052 A * 2/1991 Verhoeven ..... H01R 12/721 439/62
5,024,609 A * 6/1991 Piorunneck ..... H01R 12/721 439/924.1
5,035,631 A * 7/1991 Piorunneck ..... H01R 12/721 439/60

(Continued)

FOREIGN PATENT DOCUMENTS

CN 2930006 Y 8/2007
CN 103427183 A 12/2013

(Continued)

*Primary Examiner* — Marcus E Harcum
(74) *Attorney, Agent, or Firm* — Locke Lord LLP; Tim Tingkang Xia, Esq.

(57) ABSTRACT

An electrical connector includes a body and multiple conductive terminals. The body has an insertion slot. Each conductive terminal has a contact portion entering the insertion slot and a conductive portion passing downward beyond a bottom surface of the body. Each side of the insertion slot has first terminal groups and second terminal groups. The conductive portions of each first terminal group are located away from the insertion slot relative to the conductive portions of each second terminal group. The conductive portions are provided in four rows in a lateral direction. The conductive terminals include signal terminals and ground terminals. The circuit board has an adjusting hole and four rows of connecting points corresponding to the conductive portions. Each row of the connecting points include multiple signal connecting points and multiple ground connecting points. The adjusting hole is located between two signal connecting points in two adjacent rows.

20 Claims, 18 Drawing Sheets

(56) References Cited

U.S. PATENT DOCUMENTS 5,057,028 A * 10/1991 Lemke ..... H01R 13/6585 439/108
5,413,491 A * 5/1995 Noschese ..... H01R 12/716 439/98
5,919,049 A * 7/1999 Petersen ..... H01R 12/721 439/60
5,921,784 A * 7/1999 Petersen ..... H01R 12/58 439/60
6,007,389 A * 12/1999 Weber ..... H01R 43/20 439/857
6,019,639 A * 2/2000 Brunker ..... H01R 13/6471 439/60
6,254,435 B1 * 7/2001 Cheong ..... H01R 12/721 439/60
6,296,491 B1 * 10/2001 Pickles ..... H01R 12/721 439/60
6,315,615 B1 * 11/2001 Raistrick ..... H01R 12/585 439/733.1
6,558,200 B1 * 5/2003 Choy ..... H01R 12/725 439/108
6,780,018 B1 * 8/2004 Shipe ..... H01R 12/721 439/907
6,832,933 B2 * 12/2004 Bu ..... H01R 12/721 439/637
7,708,599 B2 * 5/2010 Guan ..... H01R 12/721 439/636
8,215,994 B2 * 7/2012 Duenas ..... H01R 13/6471 439/637
8,747,164 B2 * 6/2014 Westman ..... H01R 12/91 439/60
8,771,018 B2 * 7/2014 McGrath ..... H01R 12/55 439/630
9,054,441 B2 * 6/2015 Kimura ..... H01R 13/41
9,787,028 B2 * 10/2017 Enriquez-Shibayama ..... H01R 13/6461
9,923,309 B1 * 3/2018 Aizawa ..... H05K 1/184
10,784,608 B2 * 9/2020 Buck ..... H01R 13/6471
2003/0119366 A1 * 6/2003 Wu ..... H01R 12/721 439/636
2010/0062648 A1 * 3/2010 Guan ..... H01R 12/721 439/630
2017/0365954 A1 * 12/2017 Chen ..... H01R 24/60
2018/0276176 A1 * 9/2018 Wig ..... H05K 1/115
2019/0348783 A1 * 11/2019 Chen ..... H01R 13/6456
2019/0350079 A1 * 11/2019 Chen ..... H01R 12/737
2020/0091635 A1 * 3/2020 Horii ..... H01R 43/0256
2021/0153351 A1 * 5/2021 Li ..... H05K 5/0256

FOREIGN PATENT DOCUMENTS

CN 103972730 A 8/2014
CN 204966858 U 1/2016
CN 106686882 A 5/2017
CN 107658585 A 2/2018
CN 109586067 A 4/2019
CN 110474184 A 11/2019

* cited by examiner

4

ELECTRICAL CONNECTOR AND CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN202110099798.X filed in China on Jan. 25, 2021, and patent application Serial No. CN202120582142.9 filed in China on Mar. 22, 2021. The disclosure of each of the above applications is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a connector assembly, and particularly to a card edge connector enhancing high frequency characteristics and a connector assembly assembled by a card edge connector and an electronic card.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the electrical connector industry, there are two major trends, one of which is to reduce the whole size of the electrical connector, and the other of which is to provide more conductive terminals per unit area. Both the two trends reduce the distance between the conductive terminals. Using the Double Data Rate (DDR) connector as an example, according to the Joint Electron Device Engineering Council (JEDEC) standard, the DDR4 connector, in comparison to the DDR3 connector, has a smaller whole size of the electrical connector, but has more conductive terminals provided thereon. Thus, the distance between the conductive terminals of the DDR4 connector is shorter, and on the base plate mounting the connector, the connecting points correspondingly connected to the conductive terminals become denser, thus resulting in the signal terminals and the corresponding signal connecting points, when transmitting signals, to easily have crosstalk issues. To solve the aforementioned problem, the standard stipulates the soldering legs of some of the conductive terminals at each of the two sides of the insertion slot of the connector to bend toward a direction close to the insertion slot of the electrical connector, the soldering legs of some other conductive terminals to bend toward a direction away from the insertion slot of the electrical connector, and the two types of the terminals are arranged individually and alternately. Such configuration reduces the density of the soldering legs of the conductive terminals and the corresponding connecting points, but the crosstalk issue may still occur when transmitting signals with higher frequencies.

Therefore, a heretofore unaddressed need to design an improved electrical connector and a connector assembly exists in the art to address the aforementioned deficiencies and inadequacies.

SUMMARY

In view of the deficiency of the background, the present invention is directed to an electrical connector and a connector assembly, which improves the crosstalk phenomenon in the high frequency signal transmission by arranging the conductive terminals differently from the standard and by providing additional grounding adjusting hole between the signal connecting points of the base plate.

To achieve the foregoing objective, the present invention adopts the following technical solutions.

A connector assembly includes a base plate and an electrical connector mounted on the base plate. The electrical connector comprises a body and a plurality of conductive terminals mounted on the body, the body has an insertion slot concavely provided on a top surface of the body and extending along a front-rear direction, each of two opposite sides of the insertion slot in a left-right direction is distributed with a plurality of the conductive terminals, and each of the conductive terminals has a contact portion entering the insertion slot, a conductive portion passing downward beyond a bottom surface of the body and a connecting portion connected between the contact portion and the conductive portion; wherein the conductive terminals at each of the two opposite sides of the insertion slot comprise a plurality of first terminal groups and a plurality of second terminal groups arranged alternately along the front-rear direction, each of the first terminal groups and each of the second terminal groups are formed by two adjacent conductive terminals of the conductive terminals, and the two conductive portions of the two adjacent conductive terminals in each of the first terminal groups are located away from the insertion slot relative to the two conductive portions of the two adjacent conductive terminals in each of the second terminal groups in the left-right direction; wherein the conductive portions of the first terminal groups and the conductive portions of the second terminal groups are provided in four rows in the left-right direction, two of the four rows are provided at each of the two opposite sides of the insertion slot, the conductive portions of the first terminal groups at a same side of the insertion slot are located at one of the four rows, the conductive portions of the second terminal groups at a same side of the insertion slot are located at another one of the four rows, and the conductive terminals corresponding to each row of the conductive portions comprise a plurality of signal terminals and a plurality of ground terminals; wherein the base plate has at least one adjusting hole and four rows of connecting points corresponding to the four rows of the conductive portions, each of the rows of the connecting points comprise a plurality of signal connecting points conductively connected to the signal terminals and a plurality of ground connecting points conductively connected to the ground terminals, the adjusting hole and the ground connecting points are electrically connected through the base plate, and the adjusting hole is located between two of the signal connecting points in two adjacent rows of the four rows.

In certain embodiments, each of the second terminal groups has at least one of the signal terminals, the conductive portions of the second terminal groups at one of the two opposite sides of the insertion slot and the conductive portions of the second terminal groups at the other of the two opposite sides of the insertion slot are provided to be staggered along the front-rear direction, two rows of the four rows of the signal connecting points corresponding to the signal terminals of the second terminal groups at the two opposite sides of the insertion slot are staggered along the front-rear direction, and the adjusting hole is located between two of the signal connecting points located in the two adjacent rows and staggered.

In certain embodiments, one of the at least one adjusting hole is provided between two rows of the four rows of the signal connecting points corresponding to the first terminal groups and the second terminal groups at the same side of the insertion slot.

In certain embodiments, in the front-rear direction, the two of the signal connecting points are separated only by none or one of the ground connecting points.

In certain embodiments, the adjusting hole is located at a middle point on a virtual line connecting the two of the signal connecting points.

In certain embodiments, each of the conductive terminals is provided with only one strip connecting portion at a bottom end of the connecting portion, the strip connecting portion is located at one of a front side and a rear side of the corresponding conductive portion to be connected to a strip, and in each of the first terminal groups and each of the second terminal groups, the strip connecting portions of the two adjacent conductive terminals are located between the two corresponding conductive portions of the two adjacent conductive terminals in the front-rear direction.

In certain embodiments, the conductive portion of each of the conductive terminals bends in the left-right direction relative to the connecting portion, a bending direction of the conductive portions of the two adjacent conductive terminals of each of the first terminal groups is opposite to a bending direction of the conductive portions of the two adjacent conductive terminals of each of the second terminal groups, the conductive portion of each of the conductive terminals comprises an extending section formed by bending and extending in the left-right direction relative to the connecting portion and a leg formed by extending downward from the extending section, and the leg is conductively connected to a corresponding one of the connecting points, at the same side of the insertion slot, the connecting portions of the first terminal groups and the connecting portions of the second terminal groups are provided in a row in the front-rear direction, and an extending length of the extending section of each of the two adjacent conductive terminals of each of the second terminal groups in the left-right direction is less than an extending length of the extending section of each of the two adjacent conductive terminals of each of the first terminal groups in the left-right direction.

In certain embodiments, the electrical connector further comprises a grounding member between the conductive terminals provided at the two opposite sides of the insertion slot in the left-right direction, and the grounding member is in contact with the ground terminals corresponding to the conductive portions in two middle rows of the four rows to form electrical connections therebetween.

In certain embodiments, each of the connecting points is an electroplated through hole formed on the base plate and accommodating a corresponding one of the conductive portions, the grounding member has a plurality of grounding legs, and each of the grounding legs and the conductive portion of a corresponding one of the ground terminals are accommodated in a same one of the ground connecting points and are in contact with each other.

In certain embodiments, a hole diameter of the one of the ground connecting points simultaneously accommodating one of the grounding legs and the conductive portion of the corresponding one of the ground terminals is greater than a hole diameter of each of the other of the connecting points.

In certain embodiments, the connector assembly further includes a mating component, wherein the mating component has a mating portion formed by a printed circuit board, the mating portion is inserted downward into the insertion slot, each of two surfaces of the mating portion opposite to each other in the left-right direction has a plurality of connecting fingers, the connecting fingers at each side of the mating portion comprise a plurality of signal fingers and a plurality of ground fingers, two of the signal fingers on the two surfaces of the mating portion opposite to each other in the left-right direction are provided right toward each other, two of the ground fingers on the two surfaces of the mating portion opposite to each other in the left-right direction are provided right toward each other, each of the signal fingers is in contact with the contact portion of a corresponding one of the signal terminals, each of the ground fingers is in contact with the contact portion of a corresponding one of the ground terminals, each of the ground fingers and a corresponding one of the signal fingers on a same one of the two surfaces of the mating portion are provided to be adjacent in the front-rear direction, at least one grounding layer and a conducting structure are provided inside the mating portion, the two of the ground fingers right toward each other are electrically connected through the conducting structure, the conducting structure is connected with the grounding layer to form an electrical connection therebetween, and the grounding layer is located between the two of the signal fingers right toward each other.

In certain embodiments, the conducting structure has two conducting portions, each of the two conducting portions extends straightly and runs through the grounding layer, the two of the ground fingers right toward each other are electrically connected through the two conducting portions, one of the two conducting portions is close to a lower edge of the mating portion relative to the contact portion of each of the ground terminals, and the other of the two conducting portions is away from the lower edge of the mating portion relative to the contact portion of each of the ground terminals.

In certain embodiments, a distance between the two of the signal fingers right toward each other is less than a distance between the two conductive portions of two corresponding ones of the signal terminals in contact with the two of the signal fingers, and a distance between the two of the ground fingers right toward each other is less than a distance between the two conductive portions of two corresponding ones of the ground terminals in contact with the two of the ground fingers.

In certain embodiments, at least two grounding layers are provided inside the mating portion at intervals along the left-right direction, and an extending range of the grounding layers in the front-rear direction covers the connecting fingers on the two surfaces of the mating portion in the left-right direction.

An electrical connector is configured to be mounted on a base plate, the base plate having at least one adjusting hole and a plurality of connecting points provided in four rows in a left-right direction, each of the rows of the connecting points comprising a plurality of signal connecting points and a plurality of ground connecting points, and the adjusting hole and the ground connecting points being electrically connected through the base plate. The electrical connector includes: a body, having an insertion slot concavely provided on a top surface of the body and extending along a front-rear direction; and a plurality of conductive terminals, mounted on the body, wherein each of a left side and a right side of the insertion slot is distributed with a plurality of the conductive terminals, each of the conductive terminals has a contact portion entering the insertion slot, a conductive portion passing downward beyond a bottom surface of the body and a connecting portion connected between the contact portion and the conductive portion, and the conductive portion of each of the conductive terminals is conductively connected to one of the connecting points; wherein the conductive terminals at each of the left side and the right side of the insertion slot comprise a plurality of first terminal groups and a plurality of second terminal groups arranged alternately along the front-rear direction, each of the first terminal groups and each of the second terminal groups are formed by two adjacent conductive terminals of the conductive terminals, and the two conductive portions of the two adjacent conductive terminals in each of the first terminal groups are located away from the insertion slot relative to the two conductive portions of the two adjacent conductive terminals in each of the second terminal groups; wherein the conductive portions of the first terminal groups and the conductive portions of the second terminal groups at the left side and the right side of the insertion slot are provided in four rows in the left-right direction, two of the four rows are provided at each of the left side and the right side of the insertion slot, the conductive portions of the first terminal groups at a same side of the insertion slot are located at one of the four rows, the conductive portions of the second terminal groups at a same side of the insertion slot are located at another one of the four rows, the conductive terminals corresponding to each row of the conductive portions comprise a plurality of signal terminals and a plurality of ground terminals, the four rows of the connecting points correspond to the four rows of the conductive portions, and the adjusting hole is located between two of the connecting points in two adjacent rows of the four rows and conductively connected to the signal terminals.

In certain embodiments, each of the conductive terminals is provided with only one strip connecting portion at a bottom end of the connecting portion, the strip connecting portion is configured to be connected to a strip, the strip connecting portion and the conductive portion are connected to the connecting portion side-by-side along the front-rear direction, and in each of the first terminal groups and each of the second terminal groups, the two strip connecting portions of the two adjacent conductive terminals are located between the two corresponding conductive portions of the two adjacent conductive terminals in the front-rear direction.

In certain embodiments, the electrical connector further includes a grounding member, wherein the grounding member is between the conductive terminals provided at the two opposite sides of the insertion slot in the left-right direction, and the grounding member is in contact with the ground terminals corresponding to the conductive portions in two middle rows of the four rows to form electrical connections therebetween.

In certain embodiments, each of the connecting points is an electroplated through hole formed on the base plate and accommodating a corresponding one of the conductive portions, the grounding member has a plurality of grounding legs, and each of the grounding legs and the conductive portion of a corresponding one of the ground terminals are accommodated in a same one of the ground connecting points and are conductively connected with each other.

In certain embodiments, the conductive portion of each of the conductive terminals bends in the left-right direction relative to the connecting portion, and at the same side of the insertion slot, a bending direction of the conductive portions of the two adjacent conductive terminals of each of the first terminal groups is opposite to a bending direction of the conductive portions of the two adjacent conductive terminals of each of the second terminal groups.

In certain embodiments, the conductive portion of each of the conductive terminals comprises an extending section formed by bending and extending in the left-right direction relative to the connecting portion and a leg formed by extending downward from the extending section, and the leg is conductively connected to a corresponding one of the connecting points, at the same side of the insertion slot, the connecting portions of the first terminal groups and the connecting portions of the second terminal groups are provided in a row in the front-rear direction, and in the left-right direction, a distance between the leg and the connecting portion of each of the two adjacent conductive terminals of each of the second terminal groups is less than a distance between the leg and the connecting portion of each of the two adjacent conductive terminals of each of the first terminal groups.

Compared with the related art, certain embodiments of the present invention has the following beneficial effects.

The conductive terminals at each side of the insertion slot comprise a plurality of first terminal groups and a plurality of second terminal groups arranged alternately along the front-rear direction. Each first terminal group and each second terminal group are formed by two adjacent conductive terminals, and the two conductive portions of the two adjacent conductive terminals in each first terminal groups are located away from the insertion slot relative to the two conductive portions of the two adjacent conductive terminals in each of the second terminal groups. Thus, the two adjacent conductive portions at the same side of the insertion slot have a space to be further distanced, reducing the density of the conductive portions of the conductive terminals, and reducing the density of the connecting points on the base plate. The conductive portions of the first terminal groups and the conductive portions of the second terminal groups are provided in four rows in the left-right direction, and two of the four rows are provided at each of the two sides of the insertion slot. The base plate has at least one adjusting hole and four rows of connecting points corresponding to the four rows of the conductive portions. Each row of the connecting points include a plurality of signal connecting points conductively connected to the signal terminals and a plurality of ground connecting points conductively connected to the ground terminals. The adjusting hole and the ground connecting points are electrically connected through the base plate, and the adjusting hole is located between two signal connecting points in two adjacent rows. The grounding adjusting holes are provided, thus further reducing the crosstalk interferences between the two signal connecting points in two adjacent rows at the two sides of each adjusting hole and between the conductive portions of the corresponding signal terminals, and enhancing the integrity of the signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
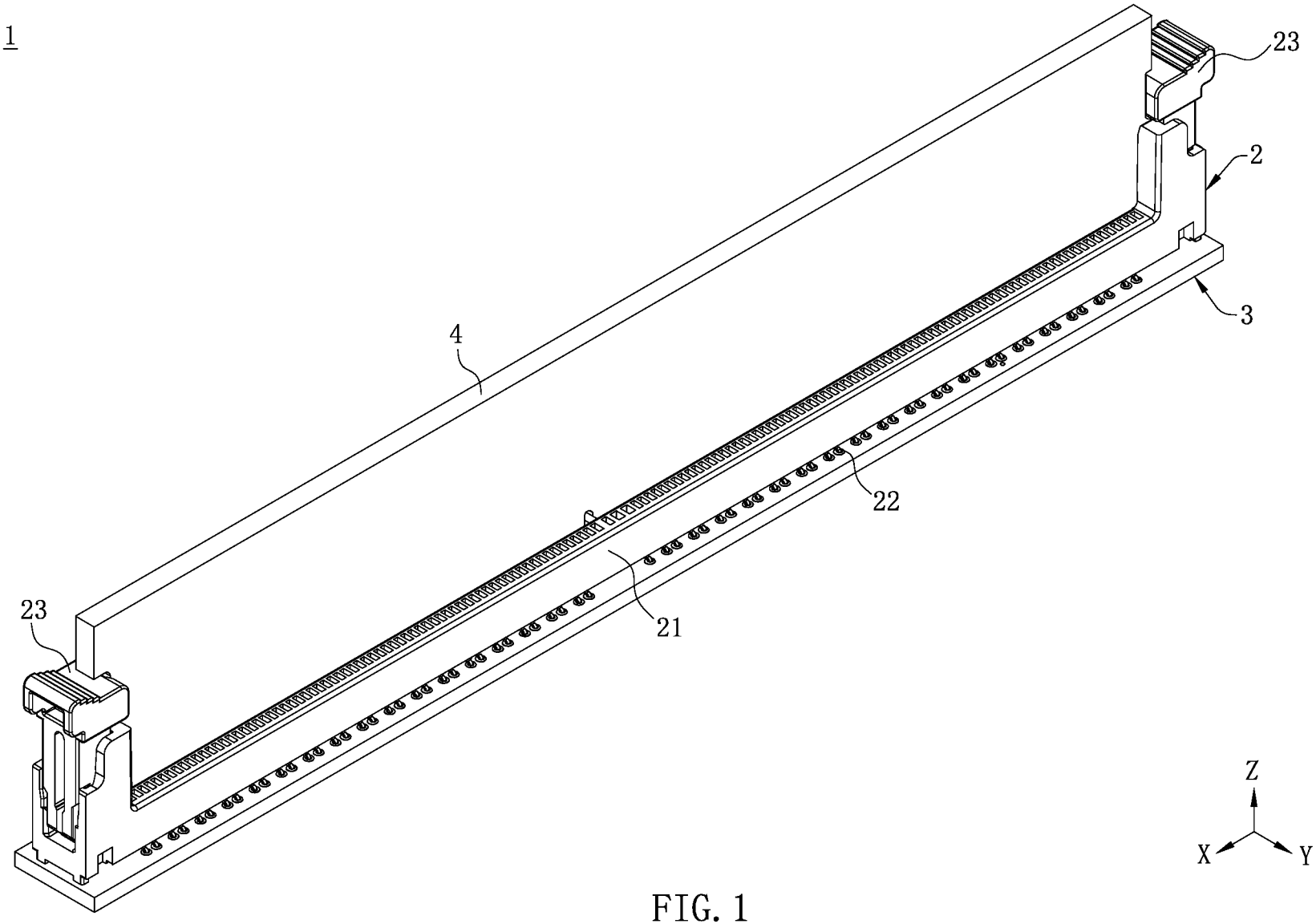
FIG. 1 is a perspective view of a connector assembly according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-18. In accordance with the purposes of this invention, as embodied and broadly described herein, this invention, in one aspect, relates to an electrical connector and a connector assembly.

FIG. 1 shows a connector assembly 1 according to a first embodiment of the present invention. The connector assembly 1 includes an electrical connector 2, a base plate 3 and a mating component 4. The electrical connector 2 is mounted on the base plate 3. The base plate 3 is a multi-layered printed circuit board. In the present invention, the DDR connector is provided only as one of the embodiments of the electrical connector 2 to describe the details of the invention, which does not limit the invention to the DDR connector. Practically, the invention may apply to the PCI-e connector, the Gen Z connector, etc. The mating component 4 is a DDR memory electronic card, which includes a multi-layered printed circuit board and a memory module provided on the printed circuit board. A portion of the mating component 4 is inserted into the electrical connector 2.

Figure 2:
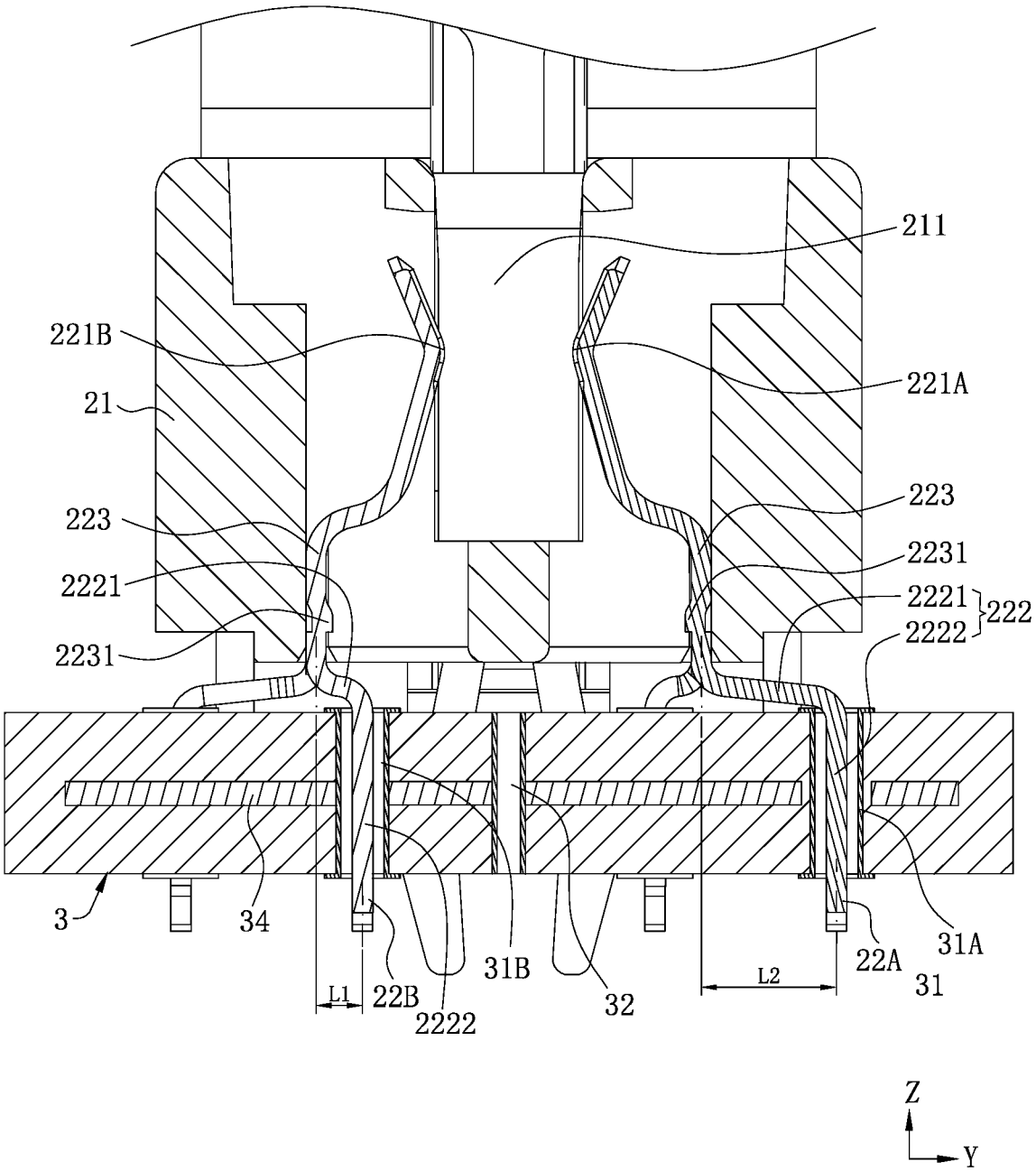
FIG. 2 is a sectional view of FIG. 1 along the left-right direction after ignoring the mating component and prior to the mating component being inserted into the electrical connector.

As shown in FIG. 1 and FIG. 2, the electrical connector 2 includes a body 21 and a plurality of conductive terminals 22 mounted on the body 21. The body 21 is formed by an insulating material, and has an insertion slot 211 concavely provided on a top surface thereof and extending along a front-rear direction X. The insertion slot 211 is used for the mating component 4 to be inserted downward therein. The front-rear direction X is perpendicular to a vertical direction Z. The electrical connector 2 is provided with two retainers 23 at two ends of the insertion slot 211 in the front-rear direction X to fix the mating component 4.

Figure 3:
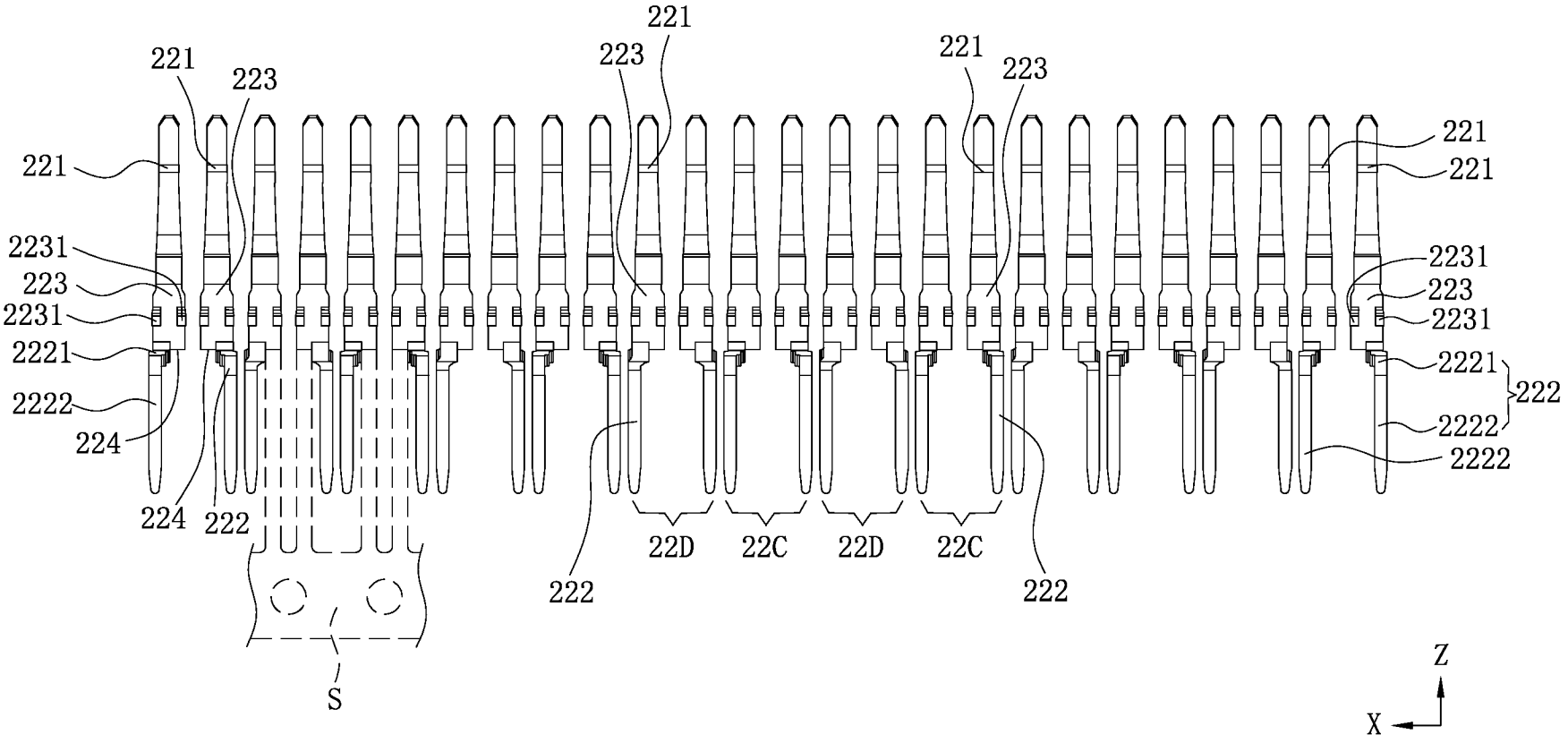
FIG. 3 is a schematic view of the first terminal groups and the second terminal groups arranged alternately in the front-rear direction in FIG. 1.

As shown in FIG. 2 and FIG. 3, the conductive terminals 22 are arranged at two sides of the insertion slot 211 in a left-right direction Y, where the left-right direction Y is perpendicular to the front-rear direction X and the vertical direction Z. Each of the two sides of the insertion slot 211 is distributed with a plurality of the conductive terminals 22, and the conductive terminals 22 are all ranged along the front-rear direction X. The conductive terminals 22 include a plurality of signal terminals 22A and a plurality of ground terminals 22B.

Figure 4:
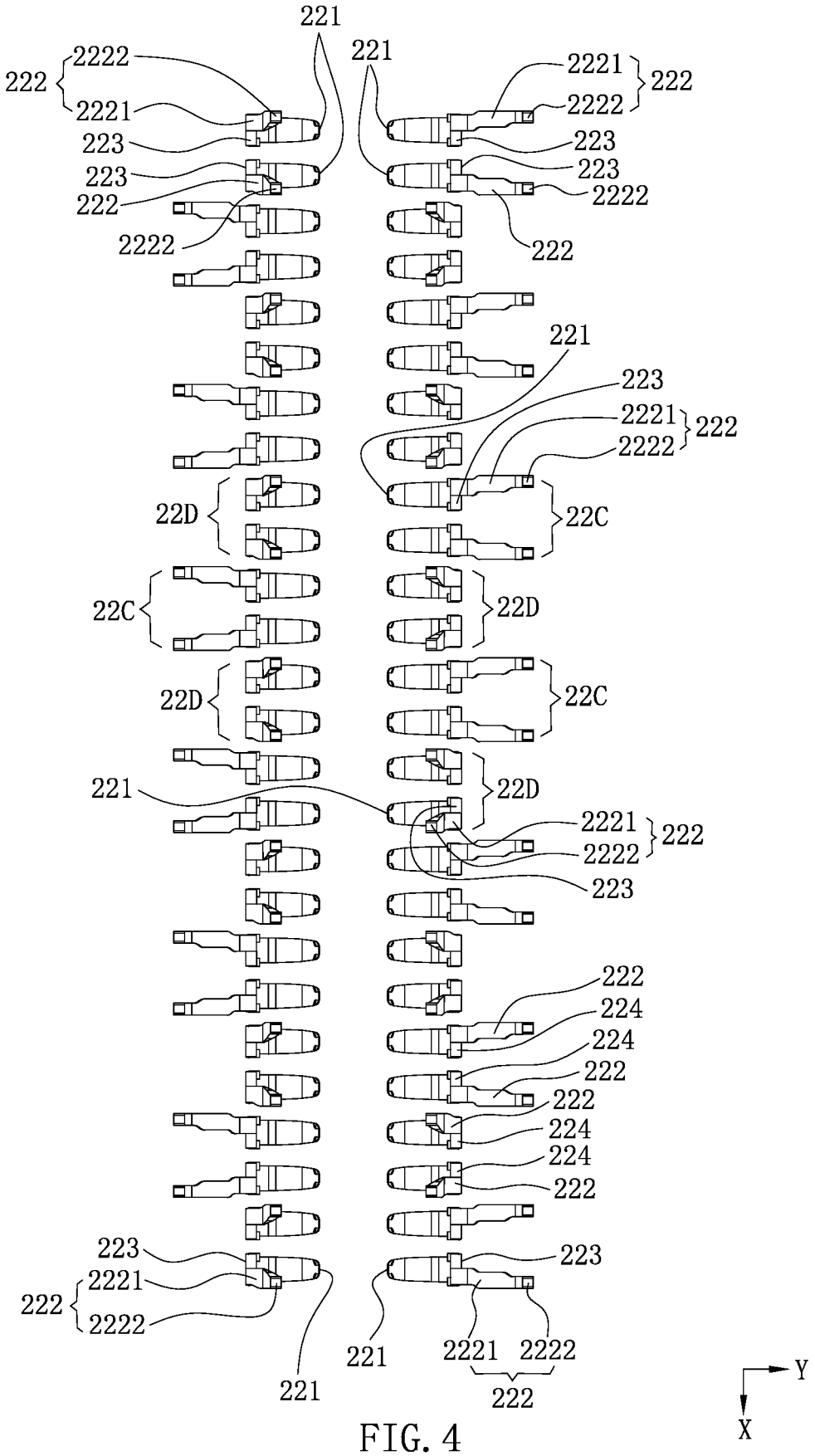
FIG. 4 is a bottom view of FIG. 3.

As shown in FIG. 2 to FIG. 4, each conductive terminal 22 has a contact portion 221 entering the insertion slot 211, a conductive portion 222 passing downward beyond a bottom surface of the body 21, and a connecting portion 223 connected between the contact portion 221 and the conductive portion 222. The contact portion 221 is used to be in contact with the mating component 4. The contact portion 221 of each signal terminal 22A is defined as a first contact portion 221A, and the contact portion 221 of each ground terminal 22B is defined as a second contact portion 221B. The connecting portion 223 has two clamping points 2231, and each conductive terminal 22 is mounted on the body 21 by the interferences between the clamping points 2231 and the body 21. The conductive portion 222 bends in the left-right direction Y relative to the connecting portion 223. The conductive portion 222 includes an extending section 2221 formed by bending and extending in the left-right direction Y relative to the connecting portion 223 and a leg 2222 formed by extending downward from the extending section 2221. In this embodiment, the leg 2222 is mounted on the base plate 3 by soldering to facilitate the conductive connection with the base plate 3. Each conductive terminal 22 has only one strip connecting portion 224, which is used to be connected to a strip S. The strip connecting portion 224 is located at a bottom end of the connecting portion 223, and the strip connecting portion 224 and the corresponding conductive portion 222 are connected to the connecting portion 223 side-by-side along the front-rear direction X. In other embodiments, the conductive portion 222 may be surface-mounted onto the base plate 3.

As shown in FIG. 2 to FIG. 4, the conductive terminals 22 at each side of the insertion slot 211 include a plurality of first terminal groups 22C and a plurality of second terminal groups 22D arranged alternately along the front-rear direction X. Each first terminal group 22C and each second terminal group 22D are formed by two adjacent conductive terminals 22. At a same side of the insertion slot 211, the connecting portions 223 of the first terminal groups 22C and the connecting portions 223 of the second terminal groups 22D are provided in a row in the front-rear direction X. The two conductive portions 222 of the two adjacent conductive terminals 22 in each first terminal group 22C are located away from the insertion slot 211 relative to the two conductive portions 222 of the two adjacent conductive terminals 22 in each second terminal group 22D. Specifically, in this embodiment, the conductive portions 222 of each first terminal group 22C bend outward along a direction away from the insertion slot 211 relative to the connecting portions 223 thereof, and the conductive portions 222 of each second terminal group 22D bend inward along a direction close to the insertion slot 211 relative to the connecting portions 223 thereof. That is, at the same side of the insertion slot 211, a bending direction of the conductive portions 222 of the first terminal groups 22C is opposite to a bending direction of the conductive portions 222 of the second terminal groups 22D. In other embodiments, each side of the insertion slot 211 may be distributed with only one first terminal group 22C and one second terminal group 22D.

As shown in FIG. 3 and FIG. 4, in each first terminal group 22C and each second terminal group 22D, the strip connecting portions 224 of the two adjacent conductive terminals 22 are located between the two corresponding conductive portions 222 of the two adjacent conductive terminals 22 in the front-rear direction X, and in a same terminal group, the two legs 2222 deviate outward in the front-rear direction X relative to the two corresponding contact portions 221. That is, in the front-rear direction X, a distance between the two legs 2222 is greater than a distance between the two contact portions 221, such that the distance between the two adjacent legs 222 is increased in comparison to the related art. An extending length of the extending section 2221 of each of the two adjacent conductive terminals 22 of each second terminal group 22D in the left-right direction Y is less than an extending length of the extending section 2221 of each of the two adjacent conductive terminals 22 of each first terminal group 22C in the left-right direction Y. In other words, in the left-right direction, a distance L1 between the leg 2222 and the connecting portion 223 of each of the two adjacent conductive terminals 22 of each second terminal group 22D is less than a distance L2 between the leg 2222 and the connecting portion 223 of each of the two adjacent conductive terminals 22 of each first terminal group 22C.

As shown in FIG. 2 and FIG. 4, the conductive portions 222 of the first terminal groups 22C and the conductive portions 222 of the second terminal groups 22D at the two sides of the insertion slot 211 are provided in four rows in the left-right direction Y. In other words, two of the four rows are provided at each of the two sides of the insertion slot 211. The conductive terminals 22 corresponding to each row of the conductive portions 22 include a plurality of the signal terminals 22A and a plurality of the ground terminals 22B. At the same side of the insertion slot 211, the conductive portions 222 of the first terminal groups 22C are located in a row at an outer side thereof, and the conductive portions 222 of the second terminal groups 22D are located in a row at an inner side thereof. The two rows of the conductive portions 222 of the second terminal groups 22D at the two sides of the insertion slot 211 are arranged to be staggered along the front-rear direction X, and the two rows of the conductive portions 222 of the first terminal groups 22C at the two sides of the insertion slot 211 are arranged to be staggered along the front-rear direction X, such that the conductive portions 222 of the second terminal groups 22D at one side of the insertion slot 211 are aligned in the left-right direction Y to the conductive portions 222 of the first terminal groups 22C at the other side of the insertion slot 211. Such configuration allows the distance between any two conductive portions 222 aligned in the left-right direction Y to be equal. In other embodiments, the conductive terminals 22 corresponding to each row of the conductive portions 222 include only one signal terminal 22A and one ground terminal 22B.

As shown in FIG. 4, each of most of the first terminal groups 22C and the second terminal groups 22D is formed by a signal terminal 22A and a ground terminal 22B. Since the first terminal groups 22C and the second terminal groups 22D at the same side of the insertion slot 211 are arranged alternately along the front-rear direction X (also referring to FIG. 2), the second terminal groups 22D at the two sides of the insertion slot 211 are arranged to be staggered along the front-rear direction X. Of each of the first terminal groups 22C having at least one signal terminal 22A and each of the second terminal groups 22D having at least one signal terminal 22A, the signal terminal 22A and the signal terminals 22A in an adjacent row are staggered in the front-rear direction X. In the consecutive arrangement formed by the first terminal groups 22C having at least one signal terminal 22A and the second terminal groups 22D having at least one signal terminal 22A, the two signal terminals 22A in two adjacent rows are separated by no more than two ground terminals 22B in the front-rear direction X. In a same row of the conductive terminals 22, each of one of the first terminal groups 22C and an adjacent one of the second terminal groups 22D includes a signal terminal 22A and a ground terminal, and the two signal terminals 22A of the two adjacent terminal groups are provided to be adjacent to each other in the front-rear direction X.

Figure 5:
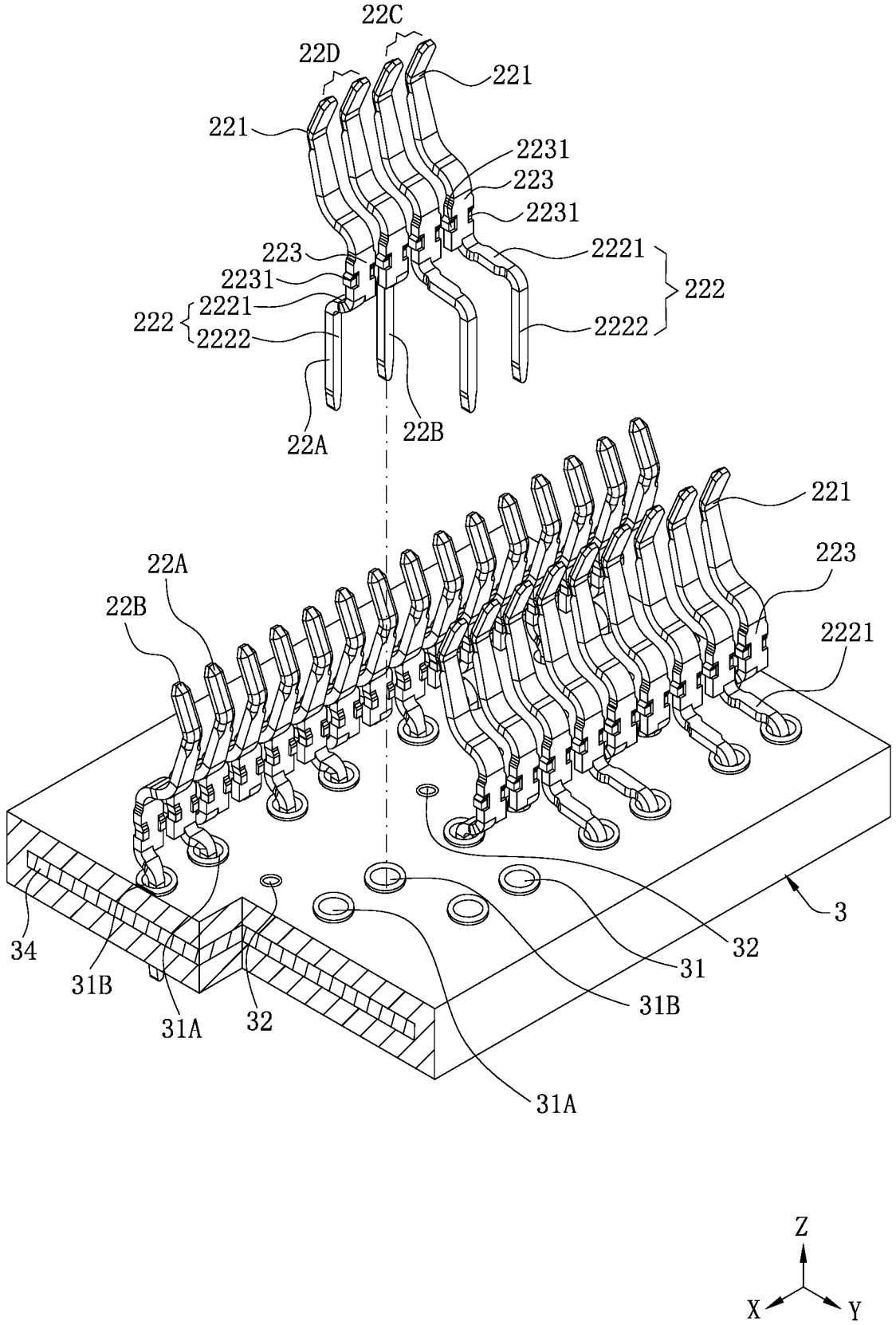
FIG. 5 is a partial perspective schematic view of the conductive terminals being conductively connected to the base plate in FIG. 1, where the viewing angle is located above the base plate.
Figure 6:
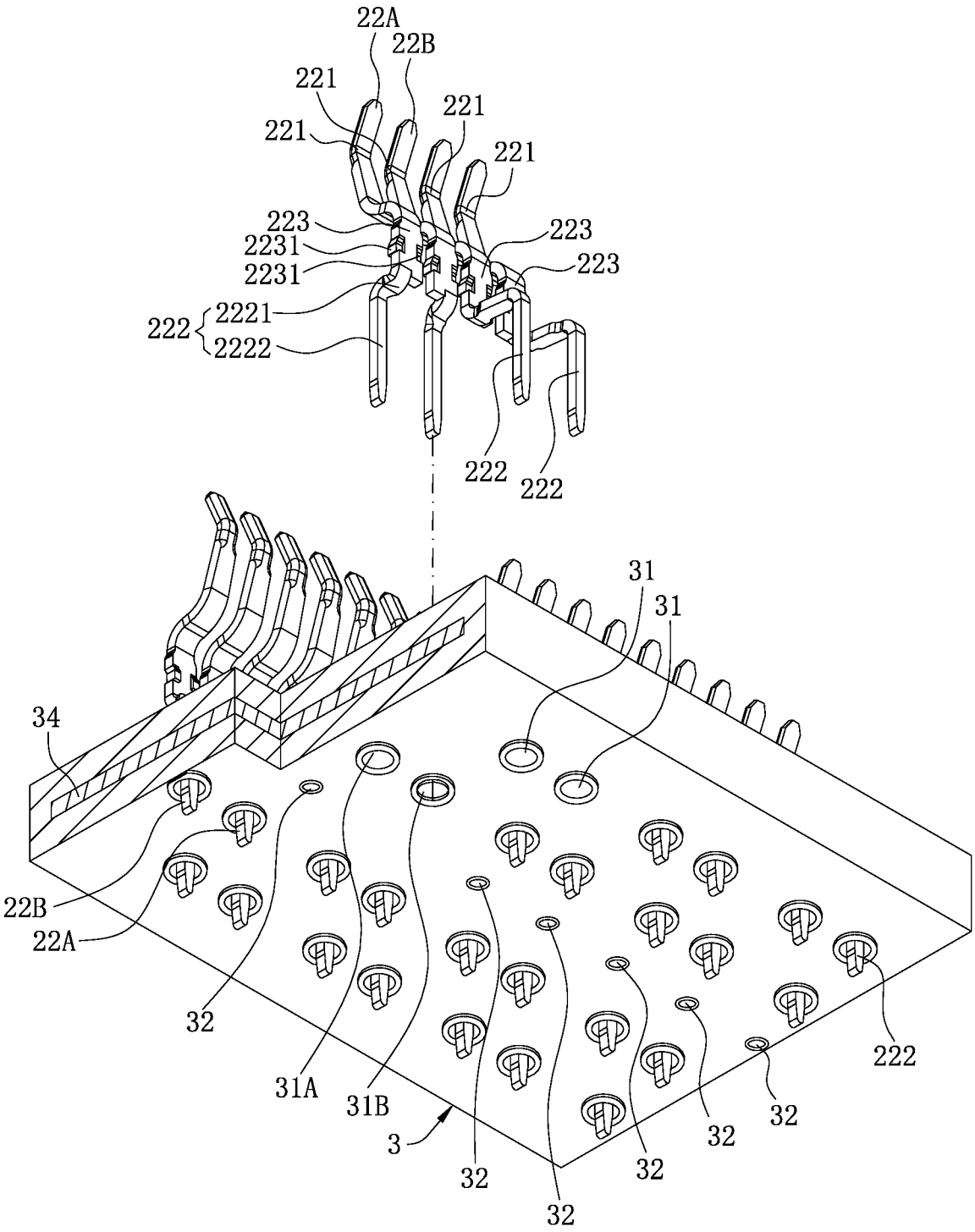
FIG. 6 is a partial perspective schematic view of the conductive terminals being conductively connected to the base plate in FIG. 1, where the viewing angle is located below the base plate.
Figure 7:
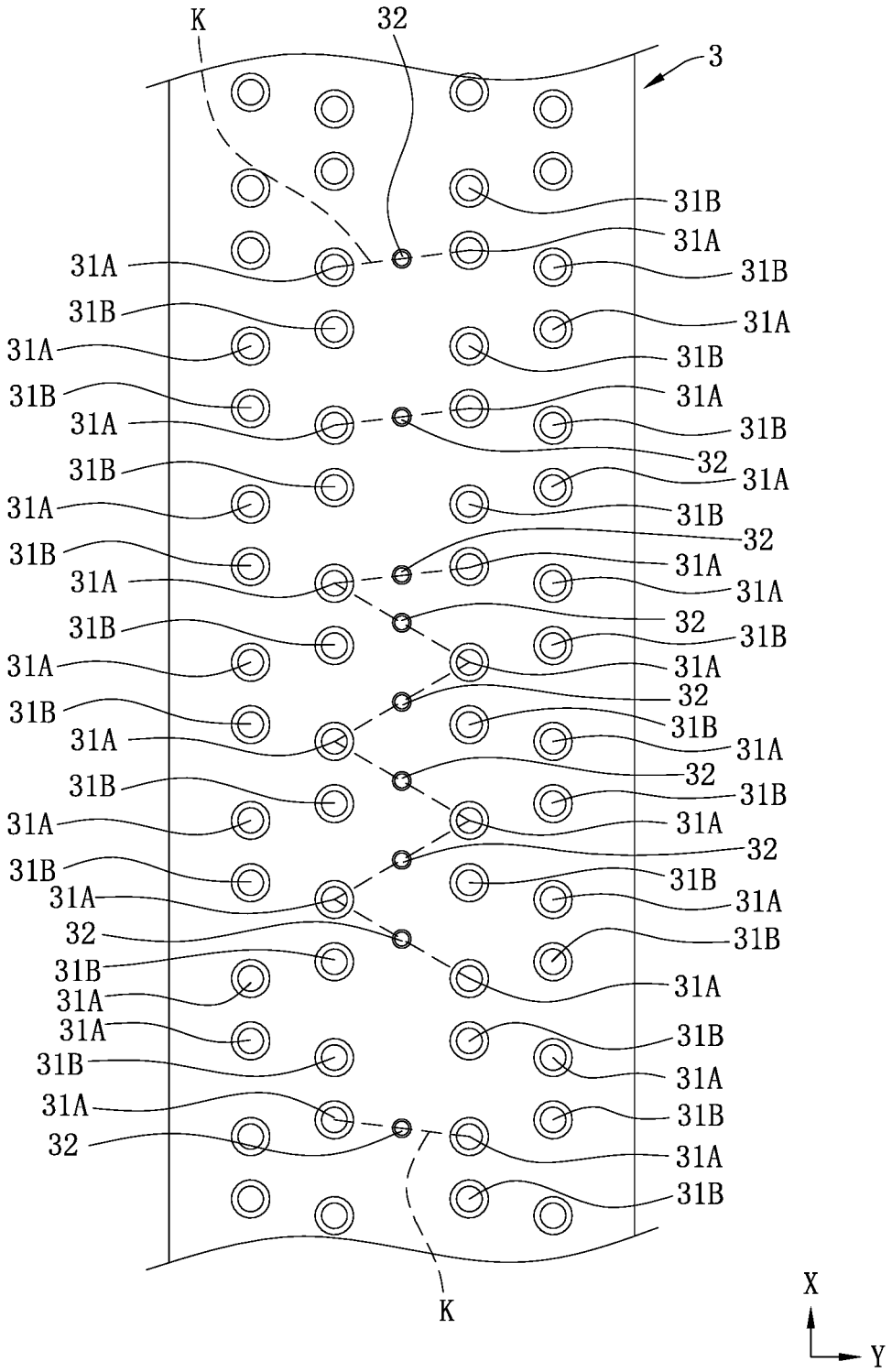
FIG. 7 is a partial top view of the base plate in FIG. 1.

As shown in FIG. 5 to FIG. 7, the base plate 3 has four rows of connecting points 31 corresponding to the four rows of the conductive portions 222. In this embodiment, each connecting point 31 is an electroplated through hole formed on the base plate 3 to accommodate the leg 2222 of a corresponding conductive portion 222. Each row of the connecting points 31 include a plurality of signal connecting points 31A conductively connected to the conductive portions 222 of the signal terminals 22A and a plurality of ground connecting points 31B conductively connected to the conductive portions 222 of the ground terminals 22B. The signal connecting points 31A in two adjacent rows, corresponding to the signal terminals 22A, are staggered in the front-rear direction X. In the consecutive arrangement formed by the connecting points 31 corresponding to the first terminal groups 22C having at least one signal terminal 22A and the second terminal groups 22D having at least one signal terminal 22A, the two signal connecting points 31A in two adjacent rows are separated by no more than two ground connecting points 31B in the front-rear direction X.

As shown in FIG. 5 to FIG. 7, since the conductive portion 222 of a same conductive terminal 22 bends relative to the connecting portion 223, a projection of the connecting portion 223 onto the base plate 3 does not overlap with the corresponding connecting point 31, and does not overlap with the leg 2222. Thus, on the base plate 3, the density of the conductive paths of the connector assembly 1 is reduced relative to that at the location of the connecting portions 223, thus weakening the crosstalk phenomenon on the base plate 3.

As shown in FIG. 5 to FIG. 7, the base plate 3 further has a plurality of adjusting holes 32 for grounding. Each adjusting hole 32 is a through hole running through the base plate 3, but does not accommodate any part of the electrical connector 2. Instead, each adjusting hole 32 functions as a vacant hole provided on the base plate 3. The adjusting holes 32 and the ground connecting points 31B are electrically connected to each other through the grounding wire 34 in the base plate 3. Each adjusting hole 32 is provided between two specific signal connecting points 31A, thus reducing the mutual crosstalk between the two signal connecting points 31A at the two sides of each adjusting hole 32 and between the two conductive portions 222 of the two corresponding signal terminals 22A. The adjusting holes 32 are provided based on the following rule: an adjusting hole 32 is provided between the two closest signal connecting points in two adjacent rows and separated only by none or one of the ground connecting points 31B in the front-rear direction X. In this embodiment, the adjusting holes 32 are provided only between the signal connecting points 31A in the two middle rows, and each adjusting hole 32 is located at a middle point on a virtual line K connecting the two signal connecting points 31A satisfying the aforementioned rule. The virtual line K is provided to incline relative to the left-right direction Y. The adjusting holes 32 are arranged in a row along the front-rear direction X, and are located right below the insertion slot 211. Further, a hole diameter of each adjusting hole 32 is less than a hole diameter of each signal connecting point 31A and a hole diameter of each ground connecting point 31B.

Figure 8:
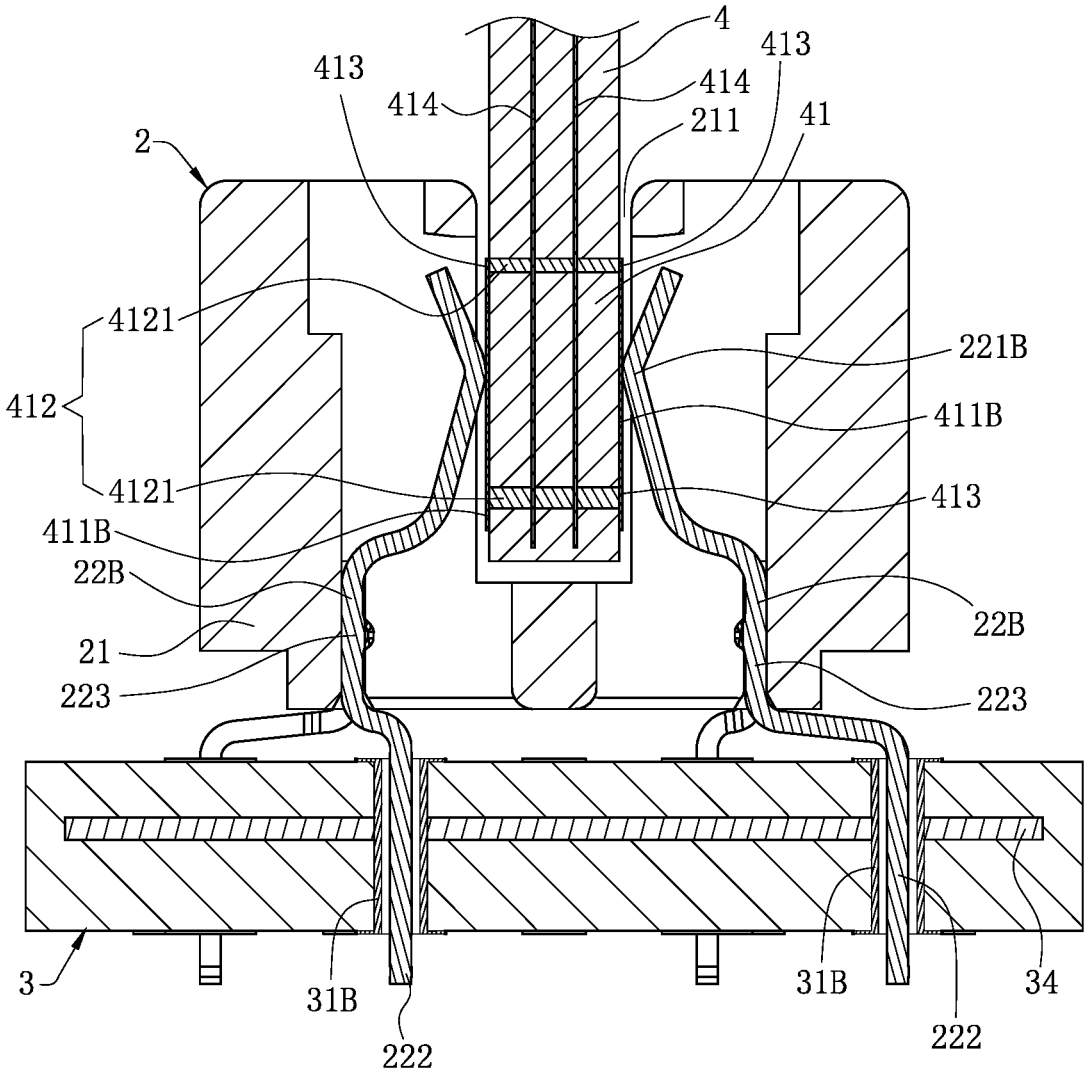
FIG. 8 is a sectional view of the ground terminals right toward each other along the left-right direction.
Figure 8:
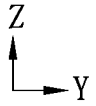
Figure 9:
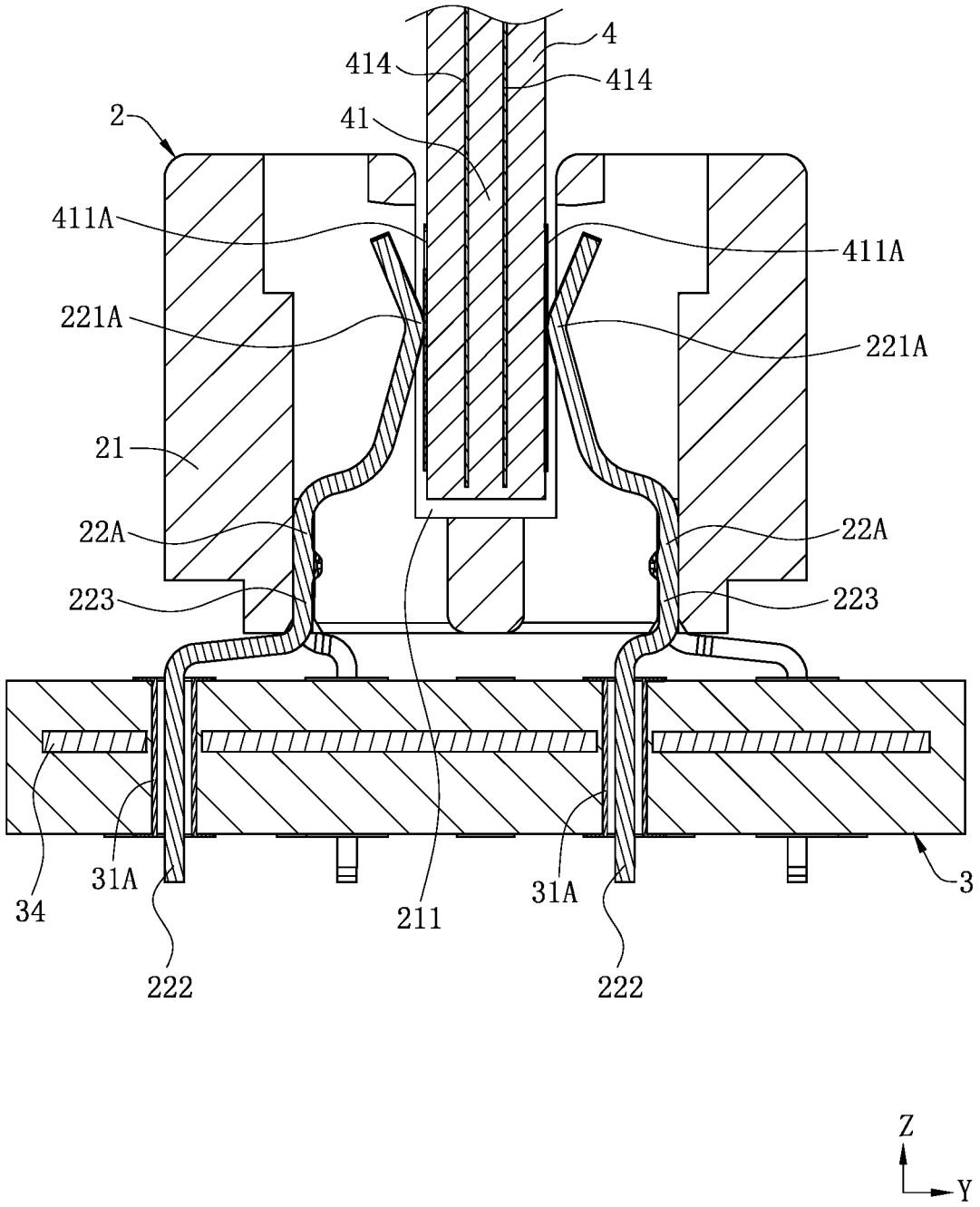
FIG. 9 is a sectional view of the signal terminals right toward each other along the left-right direction.
Figure 10:
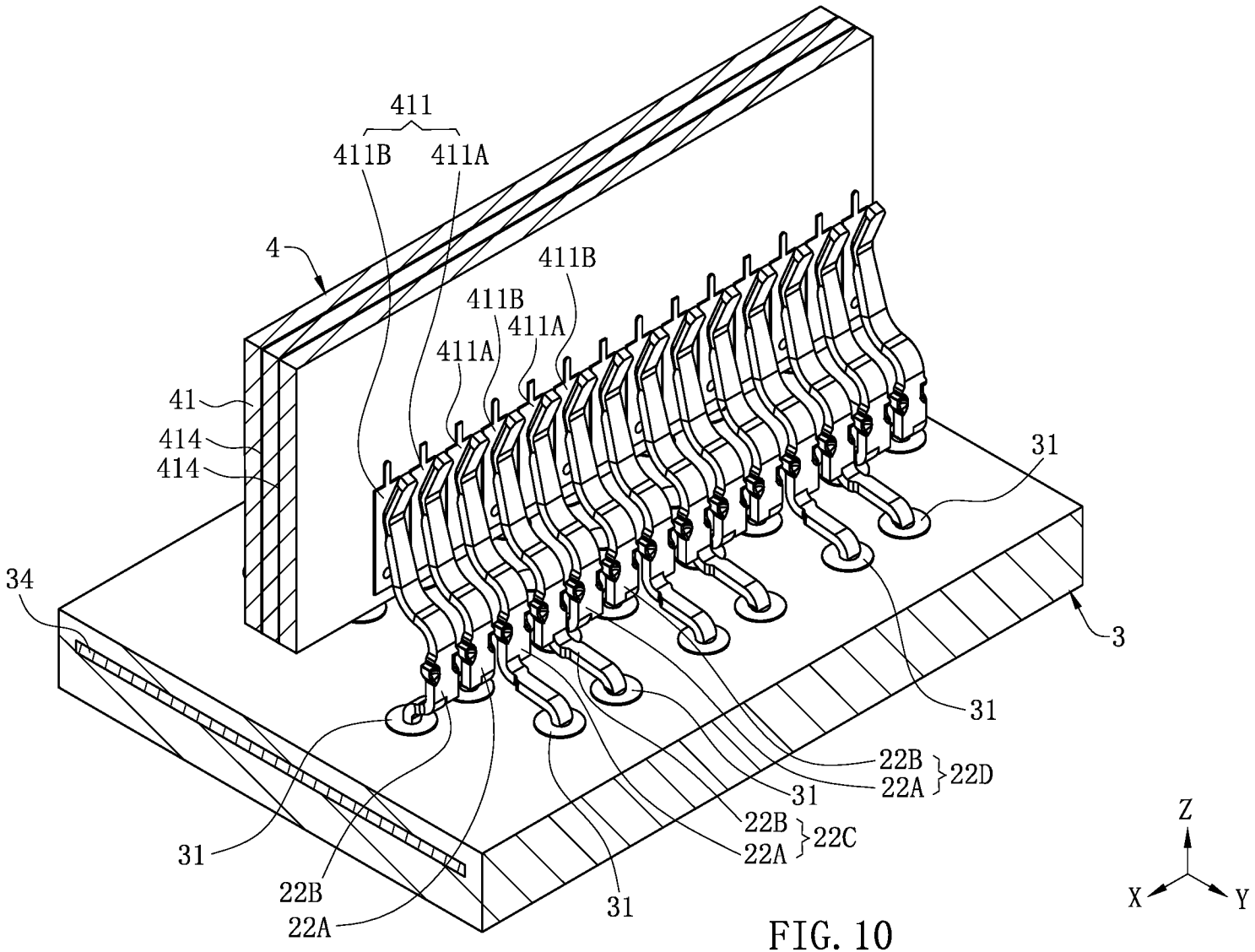
FIG. 10 is a partially enlarged view of FIG. 1 after ignoring the body of the electrical connector.

As shown in FIG. 8 to FIG. 10, the mating component 4 has a mating portion 41 formed by a printed circuit board. The mating portion 41 is inserted downward into the insertion slot 211, and has a plurality of connecting fingers 411. The connecting fingers 411 are provided on two surfaces of the mating portion 41 opposite to each other in the left-right direction, and are correspondingly in contact with the contact portions of the conductive terminals 22 at the left and right sides of the insertion slot 211. Thus, each of the two surfaces of the mating portion 41 opposite to each other in the left-right direction has a plurality of the connecting fingers 411, and the connecting fingers 411 on each surface include a plurality of signal fingers 411A and a plurality of ground fingers 411B. On the two surfaces of the mating portion 41 opposite to each other in the left-right direction, some of the signal fingers 411A are provided one-to-one right toward each other, and some of the ground fingers 411B are provided one-to-one right toward each other. Each signal finger 411A is correspondingly in contact with a first contact portion 221A, and each ground finger 411B is correspondingly in contact with a second contact portion 221B.

As shown in FIG. 8 to FIG. 10, in this embodiment, to match with the connecting finger arrangement of the mating component, in the left-right direction Y, some of the signal terminals 22A at the two sides of the insertion slot 211 are provided one-to-one right toward each other, and some of the ground terminals 22B are also provided one-to-one right toward each other. Since the electromagnetic interference is quite sensitive to the increase or decrease of the distance in the high frequency transmission, the conductive terminals 222 of the same type at the two sides of the insertion slot 211 being provided right toward each other may result in a significant increase to the mutual interference, particularly between the signal terminals 22A.

Figure 11:
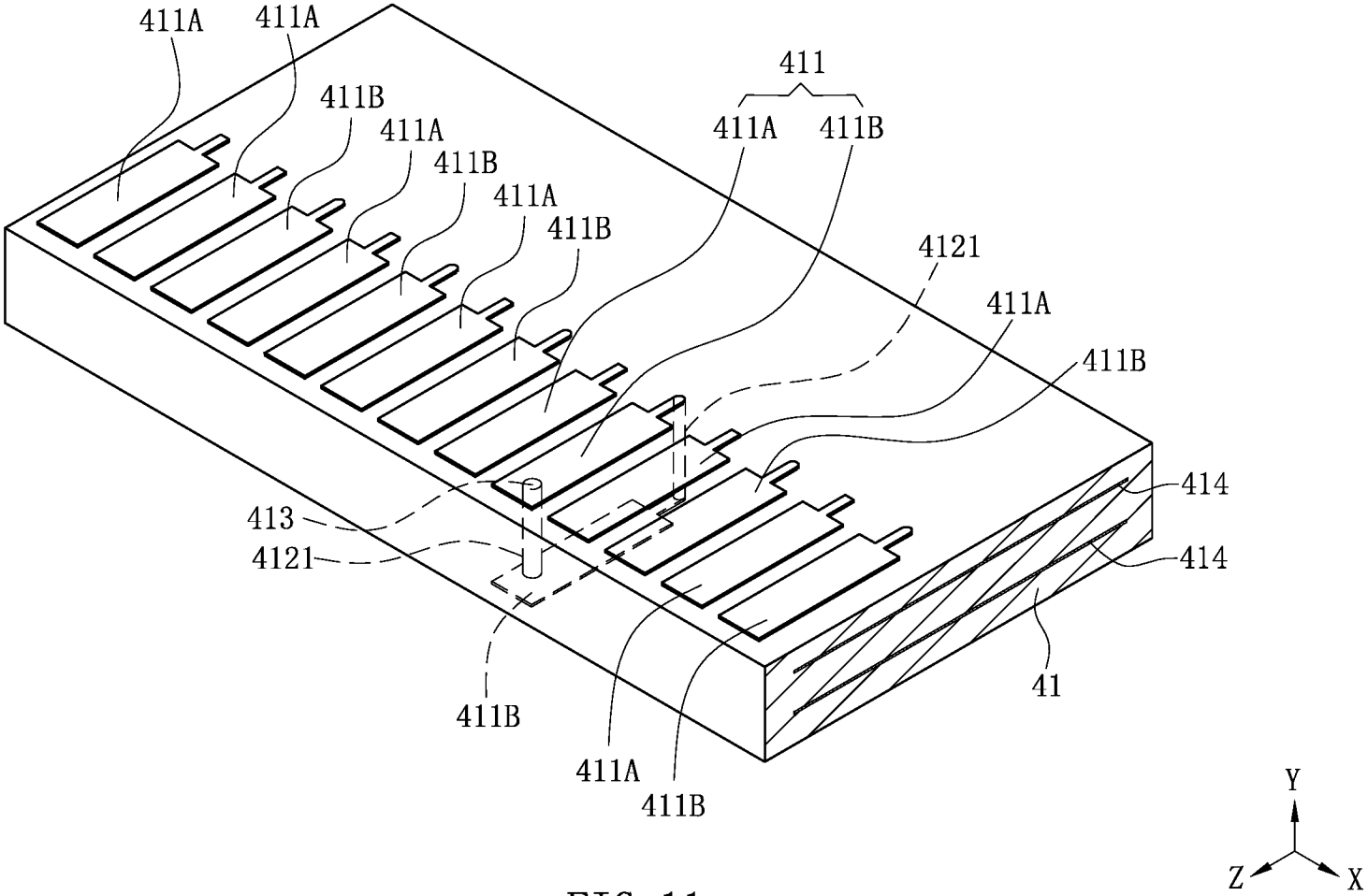
FIG. 11 is a partial schematic view of the mating portion of the mating component in FIG. 1.

As shown in FIG. 8 and FIG. 11, the mating portion 41 is provided with a conducting structure 412 between two ground fingers 411B right toward each other in the left-right direction. In this embodiment, the conducting structure 412 includes two conducting portions 4121 extending straightly, and each conducting portion 4121 is a metalized via. The two ground fingers 411B right toward each other in the left-right direction are electrically connected through the conducting portions 4121. One of the two conducting portions 4121 is close to the lower edge of the mating portion 41 relative to the first contact portion 221A, and the other of the two conducting portions 4121 is away from the lower edge of the mating portion 41 relative to the first contact portion 221A. In other words, two connection points 413 are formed between the conducting structure 412 and each ground fingers 411B and provided at an interval vertically. One of the two connection points 413 is close to the lower edge of the mating portion 41 relative to the first contact portion 221A, and the other of the two connection points 413 is away from the lower edge of the mating portion 41 relative to the first contact portion 221A. By providing the conducting structure 412 between the two ground fingers 411B right toward each other, the grounding paths for the two ground fingers 411B right toward each other are increased, thereby reducing the interference between the two ground fingers 411B right toward each other and the signal terminal 22A adjacent thereto at the two sides of the insertion slot 211.

As shown in FIG. 8 and FIG. 9, the distance between the two contact portions of the two conductive terminals 22 right toward each other in the left-right direction is less than the distance between the two conductive portions 222, and is the minimum distance between the two conductive terminals 22 in the left-right direction Y. To reduce the mutual interference between the two first contact portions 221A right toward each other at the left and right sides of the insertion slot 211, at least two grounding layers 414 are provided inside the mating portion 41 at intervals along the left-right direction Y. Each grounding layer 414 extends in the front-rear direction X, and an extending range of the grounding layers 414 in the front-rear direction covers all of the connecting fingers 411 on the two surfaces of the mating portion 41 in the left-right direction. That is, there must be two grounding layers 414 between any two connecting fingers 411 on the two surfaces of the mating portion 41 in the left-right direction, thus shielding the electromagnetic interference between the two signal fingers 411A right toward each other in the left-right direction and between the two first contact portions 211A in contact therewith. Each conducting portion 4121 extends straightly and runs through the mating portion 41 including the grounding layers 414. The two ground fingers 411B right toward each other in the left-right direction are electrically connected through the two conducting portions 4121. The ground fingers 411B at different locations in the front-rear direction X and the conducting structures 412 are connected to each other through the grounding layers 414. Such configuration increases the grounding path, and provides shielding effect to the conductive terminals 22 at the two sides of the insertion slot 211 to a certain degree. In other embodiments, more than two grounding layers 414 may be provided according to the need.

As shown in FIG. 7 and FIG. 9, the two conductive portions 222 of the two signal terminals 22A correspondingly in contact with the two signal fingers 411A right toward each other in the left-right direction are separated by exactly one row of the conductive portions 222.

In other embodiments, the conducting portions 4121 of the conducting structure 412 may be provided to be staggered in the printed circuit boards at different layers of the mating portion 41. Each conducting portion 4121 runs through only one layer of the printed circuit boards of the mating portion 41, and connects different grounding layers 414 or connects one of the grounding layers 414 and one of the ground fingers 411B.

Figure 12:
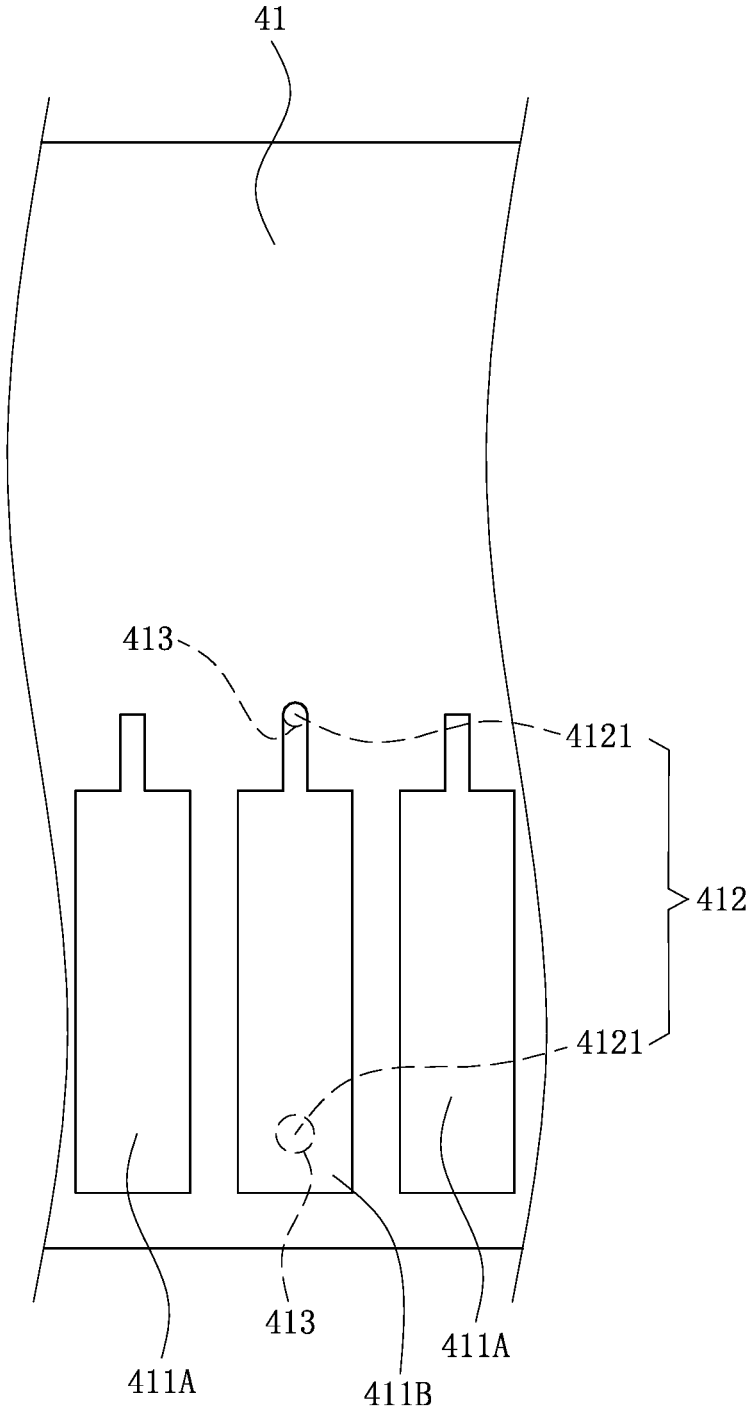
FIG. 12 is a top view of FIG. 11.

As shown in FIG. 11 and FIG. 12, in this embodiment, each conducting structure 412 is connected to a middle point of the corresponding ground finger 411B in the front-rear direction X. That is, the connection point 413 is located at the middle point of the corresponding ground finger 411B in the front-rear direction X. Such configuration may balance the effect of each conducting structure 412 to the two signal fingers 411A adjacent thereto in the front-rear direction.

As shown in FIG. 8, the conducting portions 4121 close to the lower edge of the mating portion 41 are connected to the lower ends of the ground fingers 411B, thus weakening the antenna effect of the tail ends of the ground fingers 411B. The antenna effect refers to the tail ends of the ground fingers 411B, which are substantially divided and extend from the ground terminals 22B that function as the conductive paths, thus forming the open stubs, which may easily emit electromagnetic interference, and have the effect similar to an antenna.

As shown in FIG. 8 and FIG. 12, the conducting portion 4121 close to the lower edge of the mating portion 41 is farther away from and does not easily affect other circuits (such as the memory module, not shown) on the mating component 4 relative to the conducting portion 4121 away from the lower edge of the mating portion 41. Thus, in this embodiment, the conducting portion 4121 close to the lower edge of the mating portion 41 has a hole diameter greater than that of the conducting portion 4121 away from the lower edge of the mating portion 41. Such configuration may enhance the shielding effect, and do not easily affect other circuits on the mating component 4. Since the cost for a smaller hole on the printed circuit board is higher, such configuration may control the production cost of the embodiment.

As shown in FIG. 8 and FIG. 9, the conductive portions 222 and the connecting points 31 of the base plate 3 are connected through solders (not shown), and the ground connecting points 31B connected to the ground terminals 22B are connected through the grounding wire 34 in the base plate 3. In this embodiment, each connecting point 31 is a metalized via. In other embodiments, each connecting point 31 may be a metal pad provided on the surface of the base plate 3.

Figure 13:
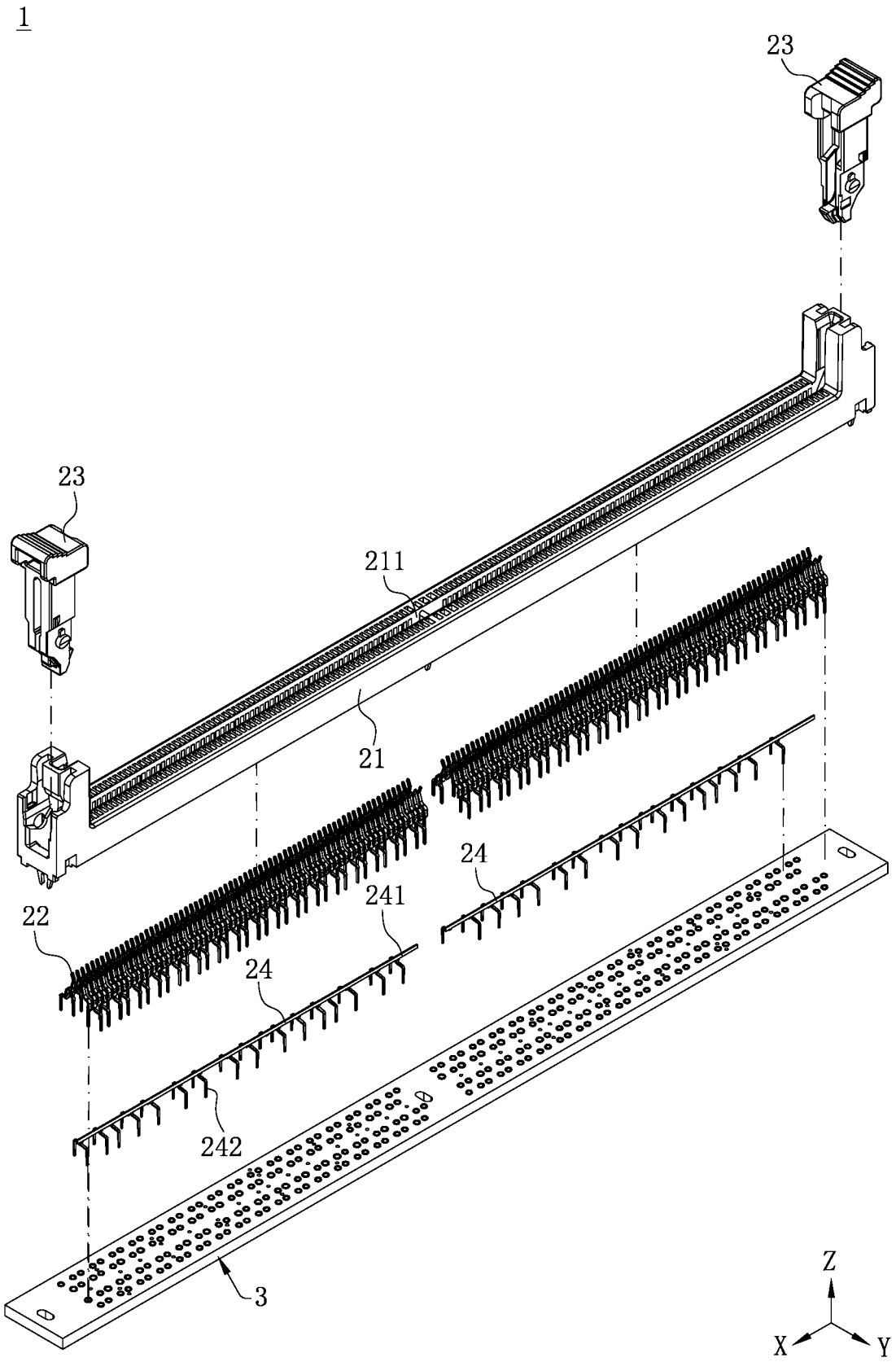
FIG. 13 is a perspective exploded view of a connector assembly according to a second embodiment of the present invention.

FIG. 13 shows an electrical connector 2 and a connector assembly 1 according to a second embodiment of the present invention. In this embodiment, the electrical connector 2 further has two grounding members 24, and the base plate 3 has more adjusting holes 32 located at other locations.

Figure 14:
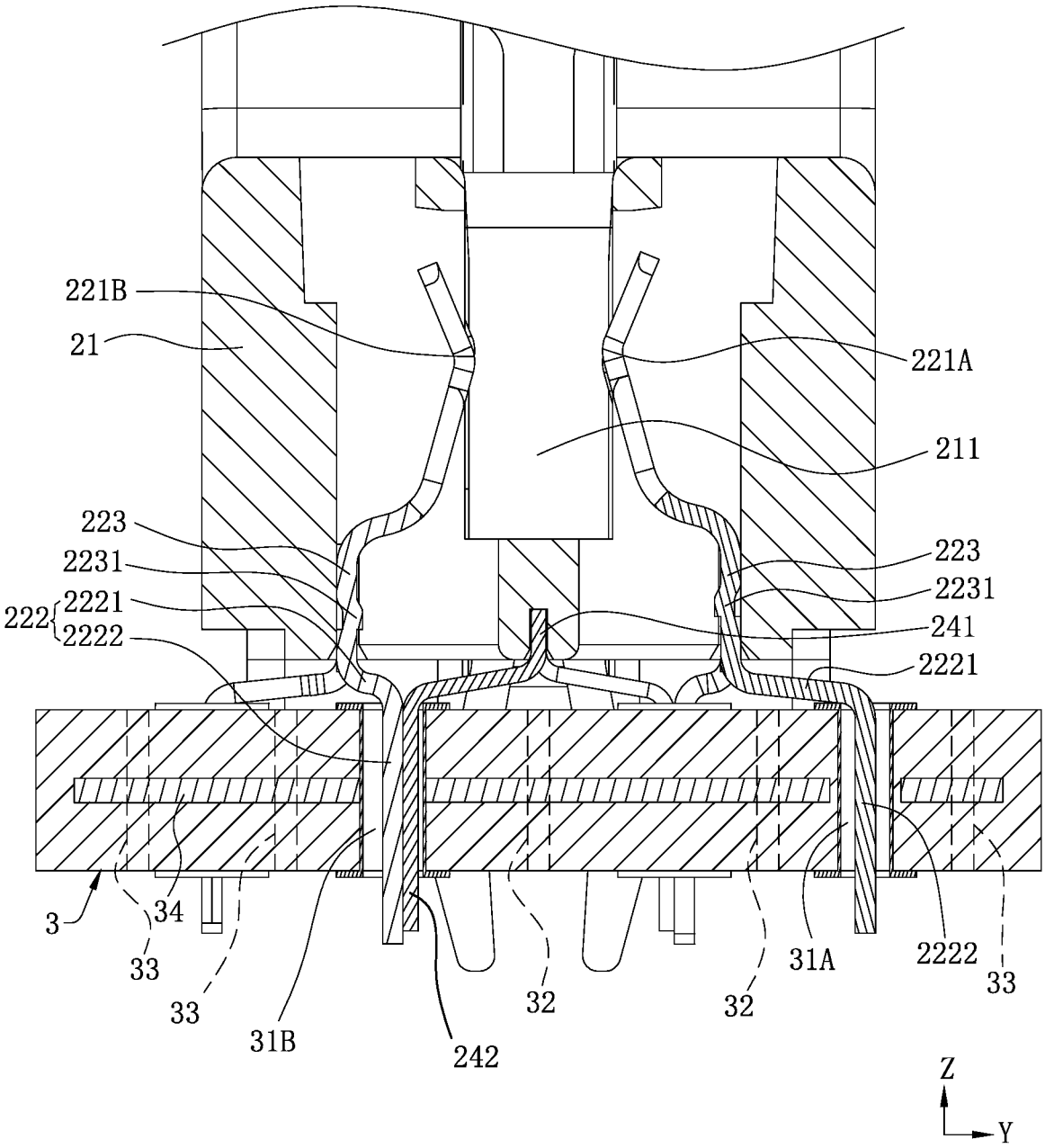
FIG. 14 is a sectional view of FIG. 13 along the left-right direction after being assembled.
Figure 15:
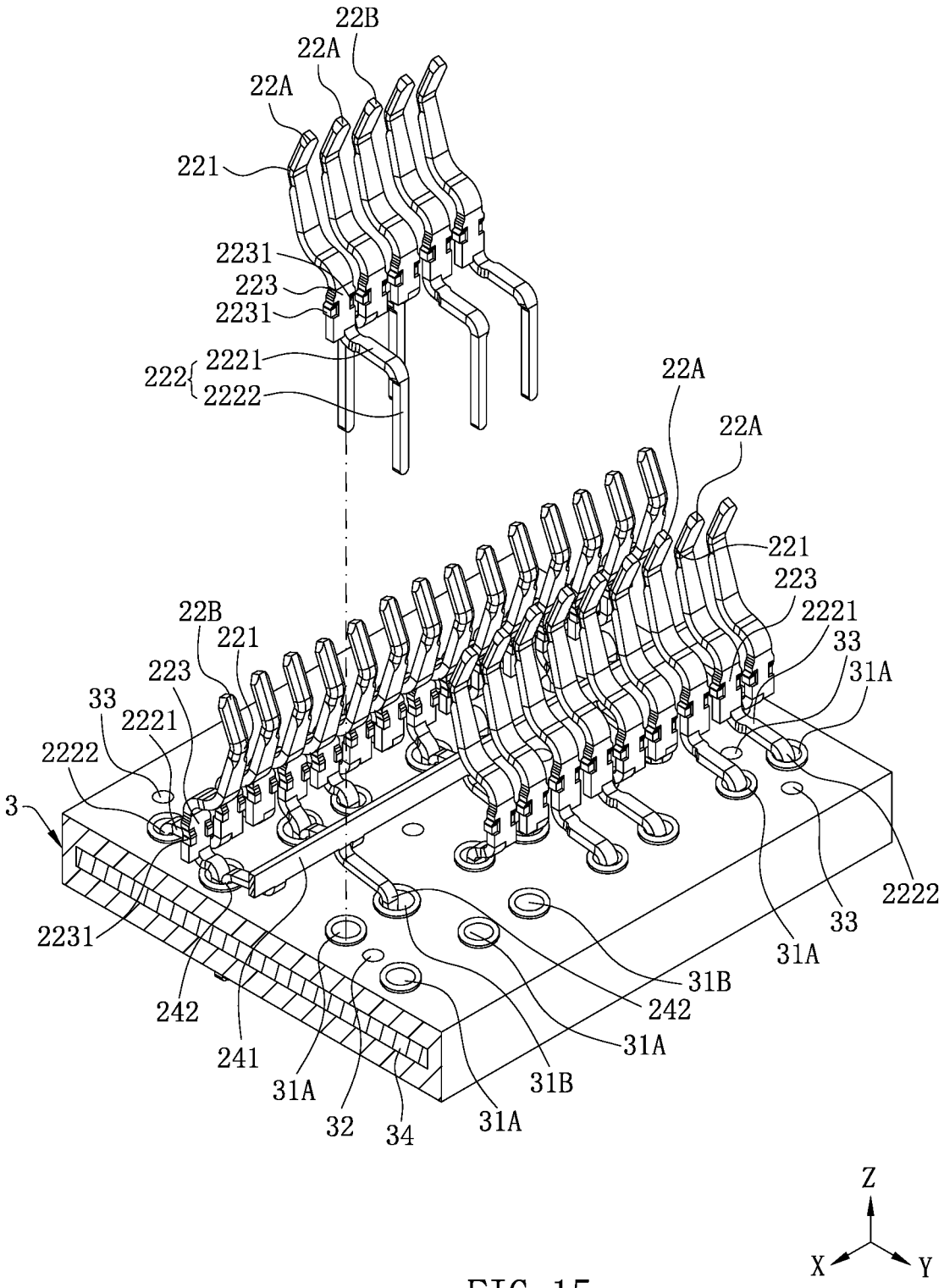
FIG. 15 is a schematic view of the conductive terminals and the grounding member conductively connected to the base plate in FIG. 13, where the viewing angle is located above the base plate.

As shown in FIG. 14 and FIG. 15, the grounding members 24 are mounted at the bottom portion of the body 21, and are provided between the conductive terminals 22 at the two sides of the insertion slot 211 in the left-right direction Y. The two grounding members 24 are arranged along the front-rear direction. Each grounding member 24 has a main body portion 241 extending along the front-rear direction X and a plurality of grounding legs 242 extending downward from the main body portion 241. The grounding legs 242 are provided to correspond to the ground terminals 22B of the two rows of the second terminal groups 22D. That is, the quantity of the grounding legs 242 is identical to the quantity of the ground connecting points 31B in the two middle rows on the base plate 3. The main body portion 241 is in a flat plate shape perpendicular to the base plate 3, and is located below the insertion slot 211 and located between the two rows of the connecting portions 223 at the two sides of the insertion slot 211, thus weakening the crosstalk between the connecting portions 223 at the two sides of the insertion slot 211 to a certain degree. The grounding legs 242 are connected to the lower end of the main body portion 241, and bend toward the conductive terminals 22 at the two sides of the insertion slot 211. The grounding legs 242 further extend downward and enter the two middle rows of the ground connecting points 31B, and are in contact with the corresponding conductive portions 222 in the ground connecting points 31B, such that the conductive portions 222 in the two middle rows are connected to each other through the grounding wire 34 of the base plate 3, and are connected through the grounding members 24, thus enhancing the grounding effect. As shown in FIG. 12, a hole diameter of each ground connecting point 31B simultaneously accommodating a corresponding grounding leg 242 and a corresponding leg 2222 is greater than a hole diameter of each of the other connecting points 31.

Figure 16:
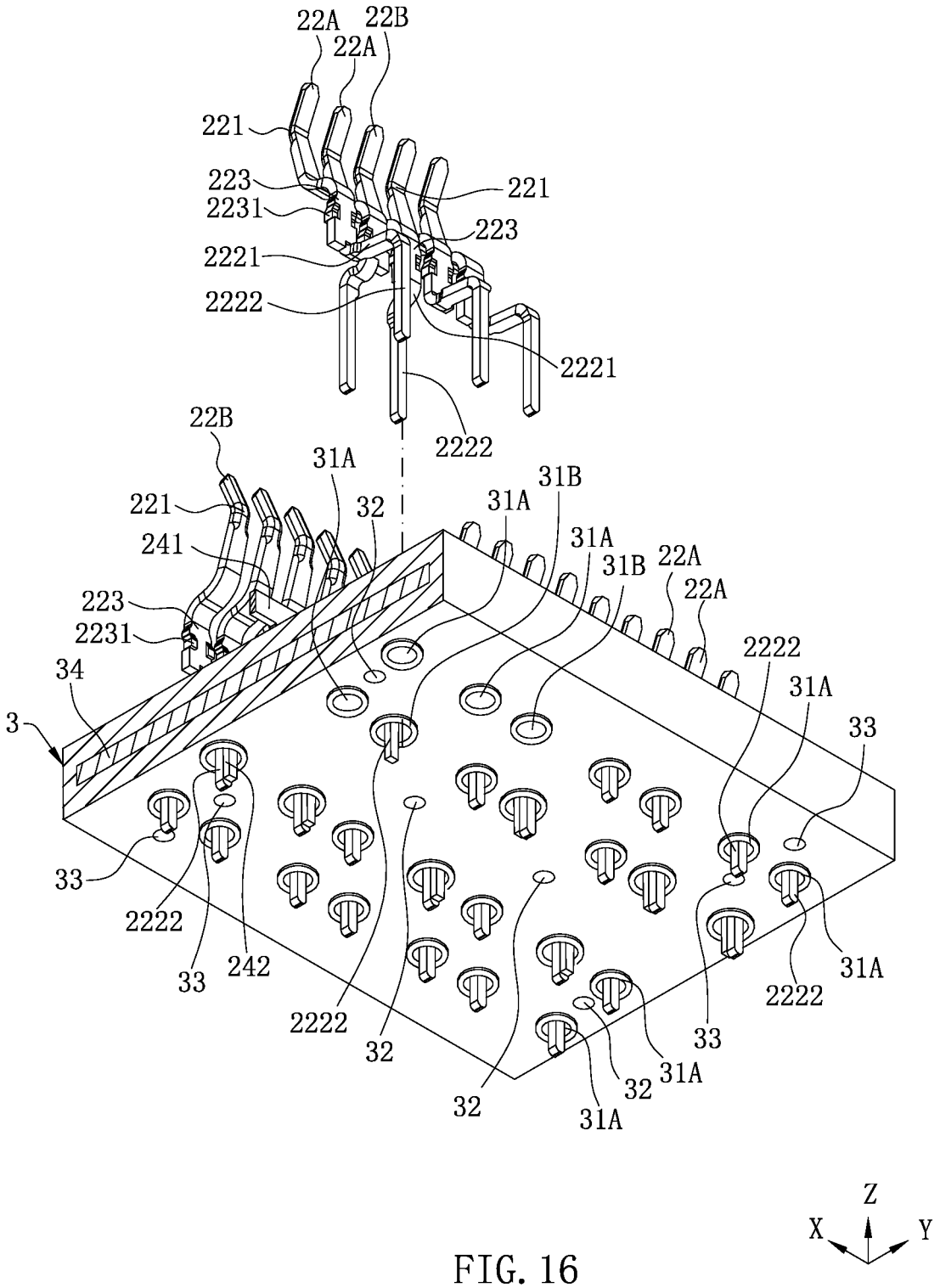
FIG. 16 is a partial perspective schematic view of the conductive terminals conductively connected to the base plate in FIG. 13, where the viewing angle is located below the base plate.
Figure 17:
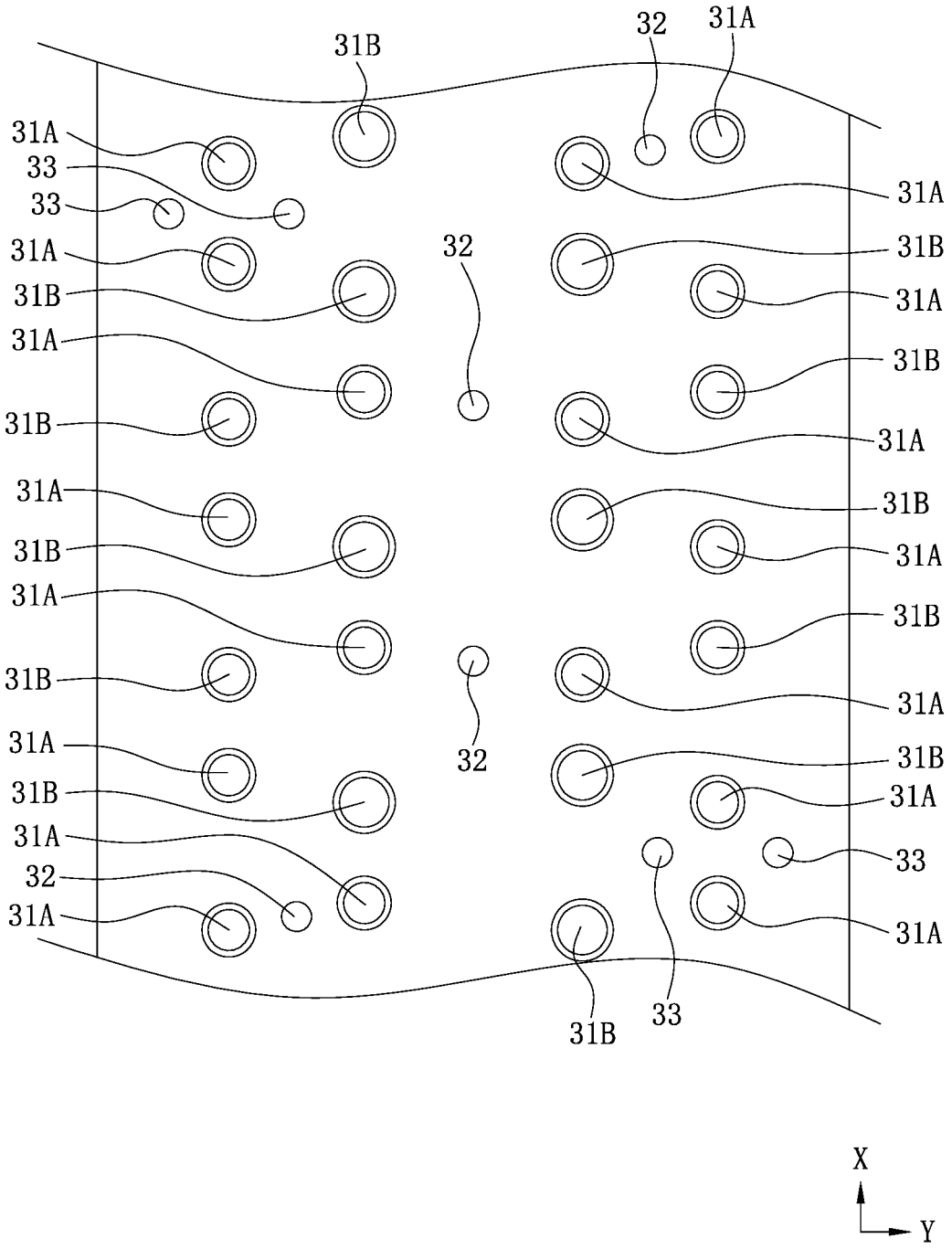
FIG. 17 is a partial top view of the base plate in FIG. 13.

As shown in FIG. 15 to FIG. 17, the adjusting holes 32 are provided between the two rows of the conductive portions 222 of the second terminal groups 22D, and are further provided between the two rows of the signal connecting points 31A corresponding to the two rows of the conductive portions 222 of the first terminal groups 22C and the second terminal groups 22D at the same side of the insertion slot 211 (also referring to FIG. 14), thus weakening the crosstalk between the signal connecting points 31A corresponding to the first terminal groups 22C and the signal connecting points 31A corresponding to the second terminal groups 22D.

As shown in FIG. 15 to FIG. 17, each of some of the first terminal groups 22C or the second terminal groups 22D of the electrical connector 2 is formed by two signal terminals 22A. At a left side and a right side of the two signal connecting points 31A corresponding to each of the first terminal groups 22C or the second terminal groups 22D in such configuration, the base plate 3 is further provided with two grounding holes 33, thus improving the high frequency characteristics of the two signal terminals 22A.

Figure 18:
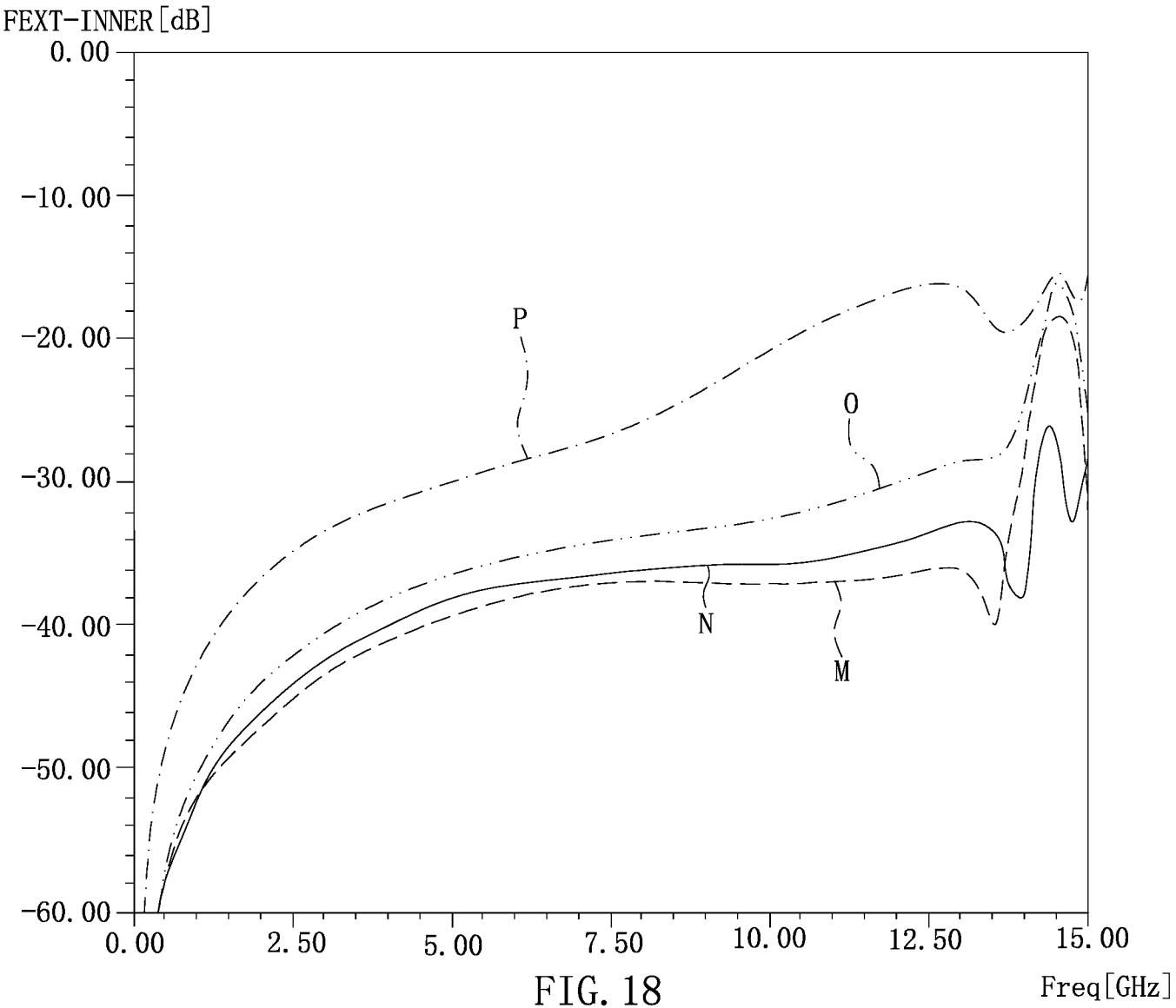
FIG. 18 is a chart showing the crosstalk strength curves of the first embodiment and the second embodiment of the present invention and the related art.

FIG. 18 shows the far end crosstalk measuring curves between the conductive portions 222 in the two middle rows of the connector assembly 1 when the electrical connector 2 is mounted on the base plate 3, that is, when the conductive portions 222 are correspondingly accommodated in the connecting points 31. As shown in FIG. 18, the vertical axis represents the strength of the crosstalk, with the unit being decibel (dB), and a smaller numerical value thereof represents a weaker crosstalk. The horizontal axis represents the frequency of the signal, with the unit being GHz. FIG. 18 includes four testing models, in which the dotted line M represents the crosstalk curve of the connector assembly 1 being provided with the adjusting holes 32 (which is the first embodiment), the solid line N represents the crosstalk curve of the connector assembly 1 being provided with the adjusting holes 32 and the grounding members 24 (which is the second embodiment), the double dotted dash line O represents the crosstalk curve of a connector assembly without the adjusting holes 32 and the grounding members 24, but including the first terminal groups 22C and the second terminal groups 22D being arranged alternately, and the dotted dash line P represents the crosstalk curve of a connector assembly without the adjusting holes 32 and the grounding members 24, and adopting the standard to arrange the conductive terminals one-to-one alternately at the same side of the insertion slot (which is the related art). Referring to FIG. 18, in the range of 0-15 GHz, the heights of the curves M and N are lower than the height of the curve O. In some of the frequency ranges, the height of the curve M is further lower than the height of the curve N. In the range of 0-15 GHz, the curves M, N and O are all lower than the curve P. In other words, by alternately arranging the conductive terminals 22 of the connector assembly 1 based on the groups of the first terminal groups 22C and the second terminal groups 22D, the crosstalk may be improved relative to the related art. By further providing the adjusting holes 32 between the two signal connecting points 31A in the two adjacent rows on this premise, the crosstalk strength may be further reduced. By additionally providing the grounding members 24, the crosstalk may be additionally weakened in certain frequency ranges.

In sum, certain embodiments of the present invention have the following beneficial effects:

(1) The conductive terminals 22 at each side of the insertion slot 211 include a plurality of first terminal groups 22C and a plurality of second terminal groups 22D arranged alternately along the front-rear direction X. Each first terminal group 22C and each second terminal group 22D are formed by two adjacent conductive terminals 22. At a same side of the insertion slot 211, the connecting portions 223 of the first terminal groups 22C and the connecting portions 223 of the second terminal groups 22D are provided in a row in the front-rear direction X. The two conductive portions 222 of the two adjacent conductive terminals 22 in each first terminal group 22C are located away from the insertion slot 211 relative to the two conductive portions 222 of the two adjacent conductive terminals 22 in each second terminal group 22D. Specifically, in the aforementioned embodiment, the conductive portions 222 of each first terminal group 22C bend outward along a direction away from the insertion slot 211 relative to the connecting portions 223 thereof, and the conductive portions 222 of each second terminal group 22D bend inward along a direction close to the insertion slot 211 relative to the connecting portions 223 thereof. That is, at the same side of the insertion slot 211, a bending direction of the conductive portions 222 of the first terminal groups 22C is opposite to a bending direction of the conductive portions 222 of the second terminal groups 22D. Thus, the two adjacent conductive portions 222 at the same side of the insertion slot 211 have a space to be further distanced, reducing the density of the conductive portions 222 of the conductive terminals 22, and reducing the connecting points 31 on the base plate 3. The grounding adjusting holes 32 are provided, thus further reducing the crosstalk interferences between the two signal connecting points 31A in two adjacent rows at the two sides of each adjusting hole 32 and between the conductive portions 222 of the corresponding signal terminals 22A, and enhancing the integrity of the signals.

(2) The adjusting holes 32 are further provided based on the following rule: an adjusting hole 32 is provided between the two signal connecting points in two adjacent rows and separated only by none or one of the ground connecting points 31B in the front-rear direction X. Such configuration may reduce the crosstalk between the conductive portions 222 of the two signal terminals 22A in two adjacent rows having a sufficiently close distance therebetween and between the corresponding signal connecting points 21A.

(3) An extending length of the extending section 2221 of each of the two adjacent conductive terminals 22 of each second terminal group 22D in the left-right direction Y is less than an extending length of the extending section 2221 of each of the two adjacent conductive terminals 22 of each first terminal group 22C in the left-right direction Y. In other words, in the left-right direction, a distance between the leg 2222 and the connecting portion 223 of each of the two adjacent conductive terminals 22 of each second terminal group 22D is less than a distance between the leg 2222 and the connecting portion 223 of each of the two adjacent conductive terminals 22 of each first terminal group 22C, thus preventing the conductive portions 222 of the second terminal groups 22D at the two sides of the insertion slot 211 from being too close and causing the crosstalk to increase.

(4) The conductive portions 222 of each first terminal group 22C bend outward along a direction away from the insertion slot 211 relative to the connecting portions 223 thereof, and the conductive portions 222 of each second terminal group 22D bend inward along a direction close to the insertion slot 211 relative to the connecting portions 223 thereof. That is, at the same side of the insertion slot 211, a bending direction of the conductive portions 222 of the first terminal groups 22C is opposite to a bending direction of the conductive portions 222 of the second terminal groups 22D. Further, the conductive portions 222 of the first terminal groups 22C and the conductive portions 222 of the second terminal groups 22D in two adjacent rows are arranged to be staggered, such that the conductive portions 222 of each first terminal group 22C and the conductive portions 222 of each second terminal group 22D maintain a relatively sufficient distance from the conductive portions 222 of other first terminal groups 22C and the conductive portions 222 of other second terminal groups 22D, thus reducing the crosstalk effect therebetween.

(5) Each grounding member 24 has a main body portion 241 extending along the front-rear direction X and a plurality of grounding legs 242 extending downward from the main body portion 241. The quantity of the grounding legs 242 is identical to the quantity of the ground connecting points 31B in the two middle rows on the base plate 3. The main body portion 241 is in a flat plate shape perpendicular to the base plate 3, and is located below the insertion slot 211 and located between the two rows of the connecting portions 223 at the two sides of the insertion slot 211, thus weakening the crosstalk between the connecting portions 223 at the two sides of the insertion slot 211 to a certain degree. The grounding legs 242 are connected to the lower end of the main body portion 241, and bend toward the conductive terminals 22 at the two sides of the insertion slot 211. The grounding legs 242 further extend downward and enter the two middle rows of the ground connecting points 31B, and are in contact with the corresponding conductive portions 222 in the ground connecting points 31B, such that the conductive portions 222 in the two middle rows are connected to each other through the grounding wire 34 of the base plate 3, and are connected through the grounding members 24, thus enhancing the grounding effect.

(6) By providing the conducting structure between two ground fingers right toward each other in the left-right direction Y, the mutual interference between the conductive terminals of the same type right toward each other in the left-right direction Y may be reduced.

(7) At least two grounding layers are provided inside the mating portion and located between two signal fingers right toward each other in the left-right direction. The grounding layers are electrically connected to the connecting fingers at different locations through the conducting structures. Such configuration increases the grounding paths, and provides shielding effect to the conductive terminals at the two sides of the insertion slot to a certain degree.

(8) The conducting portion close to the lower edge of the mating portion has a hole diameter greater than that of the conducting portion away from the lower edge of the mating portion, thus enhancing the shielding effect without easily affecting other circuits on the mating component, and controlling the production cost of the embodiment.

(9) The conducting portions are connected to the lower ends of the ground fingers, thus weakening the antenna effect of the lower ends of the ground fingers.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A connector assembly, comprising:

a base plate; and an electrical connector mounted on the base plate, wherein the electrical connector comprises a body and a plurality of conductive terminals mounted on the body, the body has an insertion slot concavely provided on a top surface of the body and extending along a front-rear direction, each of two opposite sides of the insertion slot in a left-right direction is distributed with the plurality of the conductive terminals, and each of the conductive terminals has a contact portion entering the insertion slot, a conductive portion passing downward beyond a bottom surface of the body and a connecting portion connected between the contact portion and the conductive portion;

wherein the conductive terminals at each of the two opposite sides of the insertion slot comprise a plurality of first terminal groups and a plurality of second terminal groups arranged alternately along the front-rear direction, each of the first terminal groups and each of the second terminal groups are formed by two adjacent conductive terminals of the conductive terminals, and the two conductive portions of the two adjacent conductive terminals in each of the first terminal groups are located away from the insertion slot relative to the two conductive portions of the two adjacent conductive terminals in each of the second terminal groups in the left-right direction;

wherein the conductive portions of the first terminal groups and the conductive portions of the second terminal groups are provided in four rows in the left-right direction, two of the four rows are provided at each of the two opposite sides of the insertion slot, the conductive portions of the first terminal groups at a same side of the insertion slot are located at one of the four rows, the conductive portions of the second terminal groups at a same side of the insertion slot are located at another one of the four rows, and the conductive terminals corresponding to each row of the conductive portions comprise a plurality of signal terminals and a plurality of ground terminals;

wherein the base plate has at least one adjusting hole and four rows of connecting points corresponding to the four rows of the conductive portions, each of the rows of the connecting points comprise a plurality of signal connecting points conductively connected to the signal terminals and a plurality of ground connecting points conductively connected to the ground terminals, the adjusting hole and the ground connecting points are electrically connected through the base plate, and the adjusting hole is located between two of the signal connecting points in two adjacent rows of the four rows.

2. The connector assembly according to claim 1, wherein each of the second terminal groups has at least one of the signal terminals, the conductive portions of the second terminal groups at one of the two opposite sides of the insertion slot and the conductive portions of the second terminal groups at the other of the two opposite sides of the insertion slot are provided to be staggered along the front-rear direction, two rows of the four rows of the signal connecting points corresponding to the signal terminals of the second terminal groups at the two opposite sides of the insertion slot are staggered along the front-rear direction, and the adjusting hole is located between two of the signal connecting points located in the two adjacent rows and staggered.

3. The connector assembly according to claim 1, wherein one of the at least one adjusting hole is provided between two rows of the four rows of the signal connecting points corresponding to the first terminal groups and the second terminal groups at the same side of the insertion slot.

4. The connector assembly according to claim 1, wherein in the front-rear direction, the two of the signal connecting points are separated only by none or one of the ground connecting points.

5. The connector assembly according to claim 4, wherein the adjusting hole is located at a middle point on a virtual line connecting the two of the signal connecting points.

6. The connector assembly according to claim 1, wherein each of the conductive terminals is provided with only one strip connecting portion at a bottom end of the connecting portion, the strip connecting portion is located at one of a front side and a rear side of the corresponding conductive portion to be connected to a strip, and in each of the first terminal groups and each of the second terminal groups, the strip connecting portions of the two adjacent conductive terminals are located between the two corresponding conductive portions of the two adjacent conductive terminals in the front-rear direction.

7. The connector assembly according to claim 1, wherein:

the conductive portion of each of the conductive terminals bends in the left-right direction relative to the connecting portion, a bending direction of the conductive portions of the two adjacent conductive terminals of each of the first terminal groups is opposite to a bending direction of the conductive portions of the two adjacent conductive terminals of each of the second terminal groups, the conductive portion of each of the conductive terminals comprises an extending section formed by bending and extending in the left-right direction relative to the connecting portion and a leg formed by extending downward from the extending section, and the leg is conductively connected to a corresponding one of the connecting points, at the same side of the insertion slot, the connecting portions of the first terminal groups and the connecting portions of the second terminal groups are provided in a row in the front-rear direction, and an extending length of the extending section of each of the two adjacent conductive terminals of each of the second terminal groups in the left-right direction is less than an extending length of the extending section of each of the two adjacent conductive terminals of each of the first terminal groups in the left-right direction.

8. The connector assembly according to claim 1, wherein the electrical connector further comprises a grounding member between the conductive terminals provided at the two opposite sides of the insertion slot in the left-right direction, and the grounding member is in contact with the ground terminals corresponding to the conductive portions in two middle rows of the four rows to form electrical connections therebetween.

9. The connector assembly according to claim 8, wherein each of the connecting points is an electroplated through hole formed on the base plate and accommodating a corresponding one of the conductive portions, the grounding member has a plurality of grounding legs, and each of the grounding legs and the conductive portion of a corresponding one of the ground terminals are accommodated in a same one of the ground connecting points and are in contact with each other.

10. The connector assembly according to claim 9, wherein a hole diameter of the one of the ground connecting points simultaneously accommodating one of the grounding legs and the conductive portion of the corresponding one of the ground terminals is greater than a hole diameter of each of the other of the connecting points.

11. The connector assembly according to claim 1, further comprising a mating component, wherein the mating component has a mating portion formed by a printed circuit board, the mating portion is inserted downward into the insertion slot, each of two surfaces of the mating portion opposite to each other in the left-right direction has a plurality of connecting fingers, the connecting fingers at each side of the mating portion comprise a plurality of signal fingers and a plurality of ground fingers, two of the signal fingers on the two surfaces of the mating portion opposite to each other in the left-right direction are provided right toward each other, two of the ground fingers on the two surfaces of the mating portion opposite to each other in the left-right direction are provided right toward each other, each of the signal fingers is in contact with the contact portion of a corresponding one of the signal terminals, each of the ground fingers is in contact with the contact portion of a corresponding one of the ground terminals, at least one grounding layer and a conducting structure are provided inside the mating portion, the two of the ground fingers right toward each other are electrically connected through the conducting structure, the conducting structure is connected with the grounding layer to form an electrical connection therebetween, and the grounding layer is located between the two of the signal fingers right toward each other.

12. The connector assembly according to claim 11, wherein the conducting structure has two conducting portions, each of the two conducting portions extends straightly and runs through the grounding layer, the two of the ground fingers right toward each other are electrically connected through the two conducting portions, one of the two conducting portions is close to a lower edge of the mating portion relative to the contact portion of each of the ground terminals, and the other of the two conducting portions is away from the lower edge of the mating portion relative to the contact portion of each of the ground terminals.

13. The connector assembly according to claim 11, wherein a distance between the two of the signal fingers right toward each other is less than a distance between the two conductive portions of two corresponding ones of the signal terminals in contact with the two of the signal fingers, and a distance between the two of the ground fingers right toward each other is less than a distance between the two conductive portions of two corresponding ones of the ground terminals in contact with the two of the ground fingers.

14. The connector assembly according to claim 11, wherein at least two grounding layers are provided inside the mating portion at intervals along the left-right direction, and an extending range of the grounding layers in the front-rear direction covers the connecting fingers on the two surfaces of the mating portion in the left-right direction.

15. An electrical connector, configured to be mounted on a base plate, the base plate having at least one adjusting hole and a plurality of connecting points provided in four rows in a left-right direction, each of the rows of the connecting points comprising a plurality of signal connecting points and a plurality of ground connecting points, the adjusting hole and the ground connecting points being electrically connected through the base plate, the electrical connector comprising:

a body, having an insertion slot concavely provided on a top surface of the body and extending along a front-rear direction; and a plurality of conductive terminals, mounted on the body, wherein each of a left side and a right side of the insertion slot is distributed with a plurality of the conductive terminals, each of the conductive terminals has a contact portion entering the insertion slot, a conductive portion passing downward beyond a bottom surface of the body and a connecting portion connected between the contact portion and the conductive portion, and the conductive portion of each of the conductive terminals is conductively connected to one of the connecting points;

wherein the conductive terminals at each of the left side and the right side of the insertion slot comprise a plurality of first terminal groups and a plurality of second terminal groups arranged alternately along the front-rear direction, each of the first terminal groups and each of the second terminal groups are formed by two adjacent conductive terminals of the conductive terminals, and the two conductive portions of the two adjacent conductive terminals in each of the first terminal groups are located away from the insertion slot relative to the two conductive portions of the two adjacent conductive terminals in each of the second terminal groups;

wherein the conductive portions of the first terminal groups and the conductive portions of the second terminal groups are provided in four rows in the left-right direction, two of the four rows are provided at each of the left side and the right side of the insertion slot, the conductive portions of the first terminal groups at a same side of the insertion slot are located at one of the four rows, the conductive portions of the second terminal groups at a same side of the insertion slot are located at another one of the four rows, the conductive terminals corresponding to each row of the conductive portions comprise a plurality of signal terminals and a plurality of ground terminals, the four rows of the connecting points correspond to the four rows of the conductive portions, and the adjusting hole is located between two of the connecting points in two adjacent rows of the four rows and conductively connected to the signal terminals.

16. The electrical connector according to claim 15, wherein each of the conductive terminals is provided with only one strip connecting portion at a bottom end of the connecting portion, the strip connecting portion is configured to be connected to a strip, the strip connecting portion and the conductive portion are connected to the connecting portion side-by-side along the front-rear direction, and in each of the first terminal groups and each of the second terminal groups, the two strip connecting portions of the two adjacent conductive terminals are located between the two corresponding conductive portions of the two adjacent conductive terminals in the front-rear direction.

17. The electrical connector according to claim 15, further comprising a grounding member, wherein the grounding member is between the conductive terminals provided at the two opposite sides of the insertion slot in the left-right direction, and the grounding member is in contact with the ground terminals corresponding to the conductive portions in two middle rows of the four rows to form electrical connections therebetween.

18. The electrical connector according to claim 17, wherein each of the connecting points is an electroplated through hole formed on the base plate and accommodating a corresponding one of the conductive portions, the grounding member has a plurality of grounding legs, and each of the grounding legs and the conductive portion of a corresponding one of the ground terminals are accommodated in a same one of the ground connecting points and are conductively connected with each other.

19. The electrical connector according to claim 15, wherein the conductive portion of each of the conductive terminals bends in the left-right direction relative to the connecting portion, and at the same side of the insertion slot, a bending direction of the conductive portions of the two adjacent conductive terminals of each of the first terminal groups is opposite to a bending direction of the conductive portions of the two adjacent conductive terminals of each of the second terminal groups.

20. The electrical connector according to claim 19, wherein the the conductive portion of each of the conductive terminals comprises an extending section formed by bending and extending in the left-right direction relative to the connecting portion and a leg formed by extending downward from the extending section, and the leg is conductively connected to a corresponding one of the connecting points, at the same side of the insertion slot, the connecting portions of the first terminal groups and the connecting portions of the second terminal groups are provided in a row in the front-rear direction, and in the left-right direction, a distance between the leg and the connecting portion of each of the two adjacent conductive terminals of each of the second terminal groups is less than a distance between the leg and the connecting portion of each of the two adjacent conductive terminals of each of the first terminal groups.

* * * * *